US012371900B2

(12) United States Patent
LeBlang

(10) Patent No.: US 12,371,900 B2
(45) Date of Patent: Jul. 29, 2025

(54) INTERLOCKING SPACER BRACES

(71) Applicant: Dennis LeBlang, Palm Desert, CA (US)

(72) Inventor: Dennis LeBlang, Palm Desert, CA (US)

( * ) Notice: Subject to any disclaimer, the term of this patent is extended or adjusted under 35 U.S.C. 154(b) by 0 days.

(21) Appl. No.: 17/960,127

(22) Filed: Oct. 4, 2022

(65) Prior Publication Data

US 2023/0082777 A1 Mar. 16, 2023

Related U.S. Application Data

(63) Continuation-in-part of application No. 17/871,964, filed on Jul. 24, 2022, now abandoned.

(51) Int. Cl.
*E04B 2/58* (2006.01)

(52) U.S. Cl.
CPC ..... *E04B 2/58* (2013.01)

(58) Field of Classification Search
CPC ..... E04C 3/07; E04C 3/292; E04C 2003/026; E04C 2003/0473; E04B 1/40; E04B 2/58; E04B 1/7608; E04B 1/7654; E04B 2001/405; E04B 2/707; E04B 2001/2415; E04B 2001/2496; E04B 1/94; E04B 1/948; E04B 1/14; E04B 1/2403; E04B 2/7411; E04B 2001/2412; E04B 2001/2481; F16L 5/04
USPC ..... 52/653.1, 654.1, 656.9, 667, 712, 243, 52/317, 349, 481.1, 655.1, 696, 715
See application file for complete search history.

(56) References Cited

U.S. PATENT DOCUMENTS

2003/0037494 A1* 2/2003 Collins ..... E04B 2/763 52/241
2003/0106280 A1* 6/2003 diGirolamo ..... E04B 2/7457 52/656.1
2004/0031224 A1* 2/2004 Elderson ..... E04B 2/7457 52/481.1
2004/0172912 A1* 9/2004 Brunt ..... E04B 2/763 52/698
2012/0144765 A1* 6/2012 LeBlang ..... E04B 2/58 52/220.2
2015/0033662 A1* 2/2015 Daudet ..... E04B 2/763 52/745.1
2017/0191254 A1* 7/2017 Daudet ..... E04B 2/763

* cited by examiner

*Primary Examiner* — Beth A Stephan

(57) ABSTRACT

Spacing bracing members connect to support members through the hole in the support members by using the notches in the spacing bracing member to intersect the hole side edges. The spacing bracing members can pass through the hole having a hook finger end without extending past the support member. Spacing bracing members overlap at the hole in the support member with the notches from the spacing bracing members engaging the hole side edges. The shape and size of the spacing bracing member can vary depending on the shape of the hole and the location and shape of the notches.

16 Claims, 20 Drawing Sheets

INTERLOCKING SPACER BRACES

CROSS REFERENCE TO RELATED APPLICATIONS

This application is a continuous-in-part pending application U.S. Ser. No. 12/456,707, filed on Jun. 22, 2009, now U.S. Pat. No. 8,161,699 and this application claims priority to the following:

Continuous-in-part pending application U.S. Ser. No. 17/960,127 filed Oct. 4, 2022 which claim benefit to Provisional application U.S. 63/313,624 filed Feb. 24, 2022, Provisional application U.S. 63/282,152 filed Nov. 22, 2021, Provisional application U.S. 63/252,615 filed Oct. 5, 2021;

Continuous-in-part pending application Ser. No. 17/871,964 filed Jul. 24, 2022 which claim benefit to Provisional application U.S. 63/313,624 filed Feb. 24, 2022, Provisional application US 63/282,152 filed Nov. 22, 2021, Provisional application U.S. 63/252,615 filed Oct. 5, 2021;

Continuous in-part pending application Ser. No. 16/657,989 filed Oct. 18, 2019, now abandoned which claim benefit to Provisional application U.S. 63/900,501 filed Sep. 14, 2019 and, Provisional application U.S. 63/898,181 filed Sep. 10, 2019 and, Continuous-in-part pending application Ser. No. 16/525,578 filed Jul. 29, 2019, now abandoned and, Continuous-in-part pending application Ser. No. 16/503,324 filed Jul. 3, 2019, now abandoned and;

Continuous-in-part pending application Ser. No. 16/449,386 filed Jun. 22, 2019, now abandoned and;

Continuous-in-part pending application Ser. No. 16/439,640 filed Jun. 12, 2019, now abandoned and;

Continuous-in-part pending application Ser. No. 16/406,289 filed May 8, 2019, now abandoned and;

Continuous-in-part pending application Ser. No. 16/396,624 filed Apr. 26, 2019, now abandoned and;

Continuous-in-part pending application Ser. No. 16/354,081 filed Mar. 14, 2019, now abandoned and;

Continuous-in-part pending application Ser. No. 16/198,831 filed Nov. 22, 2018, now abandoned and;

Continuous-in-part pending application Ser. No. 16/195,847 filed Nov. 19, 2018, now abandoned and;

Continuation-in-part application U.S. Ser. No. 15/724,137 filed Nov. 3, 2017 now Application No. 10,442, 136 issued Sep. 24, 2019 which claims benefit to Provisional application No. 62/533,092 filed Jul. 16, 2017, (now expired), Provisional application No. 62/490,917 filed Apr. 27, 2017, (now expired), Provisional application No. 62/485,114 filed Apr. 13, 2017, (now expired) and;

Continuation-in-part application Ser. No. 15/449,250 filed Mar. 3, 2017 now Application No 10,683,665 issued Jun. 16, 2020 which claims benefit to Provisional application No. 62/399,434 filed on Sep. 25, 2016, (now expired), Provisional application No. 62/385,932 filed on Sep. 9, 2016, (now expired), Provisional application No. 62/378,615 filed on Aug. 23, 2016, (now expired), Provisional application No. 62/345,153 filed on Jun. 3, 2016, (now expired), Provisional application No. 62/308,520 filed on Mar. 15, 2016, (now expired) and;

Continuation-in-part application Ser. No. 15/430,781 filed Feb. 13, 2017 now Application No issued 12,320,113, Jun. 6, 2025 which claims benefit to Provisional application No. 62/308,520 filed Mar. 15, 2016 (now expired), Provisional application No. 62/385,932 filed Sep. 9, 2016 (now expired), Provisional application No. 62/378,615, filed Aug. 23, 2016 (now expired), Provisional application No. 62/369,041, filed Jul. 30, 2016 (now expired) and, Continuation-in-part application Ser. No. 15/295,172, filed Oct. 17, 2016 which is now U.S. Pat. No. 10,364,566, issued Jul. 30, 2019, which claims benefit to Provisional application No. 62/378,615, filed Aug. 23, 2016 (now expired), Provisional application No. 62/369,041, filed Jul. 30, 2016 (now expired), Provisional application No. 62/345,153, filed Jun. 3, 2016 (now expired), Provisional application U.S. 62/294,756 filed Feb. 12, 2016 (now expired), Provisional application No. 62/274,134 filed Dec. 12, 2015 (now expired), Provisional application U.S. 62/260,033 filed Dec. 7, 2015 (now expired) and, Continuation-in-part of application Ser. No. 15/090,460 now Application No. 11,060,281 issued Jul. 13, 2021 which claims benefit to Provisional application No. 62/242,705, filed Oct. 16, 2015 (now expired), Provisional application No. 62/208,766, filed Aug. 23, 2015 (now expired), Provisional application No. 62/143,097 filed Apr. 4, 2015 (now expired), Provisional application U.S. 62/175,191, filed Jun. 12, 2015 (now expired), Provisional application No. 62/170,269, filed Jun. 3, 2015 (now expired) and, Continuation-in-part of application Ser. No. 14/946,378 filed Nov. 19, 2015 now U.S. Pat. No. 11,391,038 issued Jul. 19, 2022 which claims benefit to Provisional application No. 62/175,191, filed Jun. 12, 2015, Provisional application No. 62/170,269 filed Jun. 3, 2015, Provisional application No. 62/139,916 filed Mar. 30, 2015, Provisional application No. 62/083,276 filed Nov. 23, 2014 and, application Ser. No. 14/946,378 is a continuation-in-part of application Ser. No. 13/398,243, filed Feb. 16, 2012, which claims benefit to:

Provisional application No. 62/175,191, filed Jun. 12, 2015 (now expired),

Provisional application No. 62/170,269 filed Jun. 3, 2015 (now expired),

Provisional Application No. 62/139,916 filed Mar. 30, 2015 (now expired),

Provisional application No. 62/083,276 filed Nov. 23, 2014. (now expired) and, application Ser. No. 13/398,243 filed Feb. 16, 2012 now abandoned, claims benefit to:

Provisional application No. 61/629,522, filed Nov. 22, 2011 (now expired),

Provisional application No. 61/628,044, filed Oct. 24, 2011 (now expired) and, application Ser. No. 13/398,243 is a continuation-in-part of application Ser. No. 12/456,707 now U.S. Pat. No. 8,161,699.

application Ser. No. 15/449,250 is a continuation-in-part of application Ser. No. 15/430,781 filed Feb. 13, 2017 which claims benefit to, Provisional application No. 62/399,434 filed Sep. 25, 2016, Provisional application No. 62/385,932 filed Sep. 9, 2016, Provisional application No. 62/378,615 filed Aug. 23, 2016, Provisional application No. 62/369,041 filed Jul. 30, 2016, Provisional application No. 62/345,153 filed Jun. 3, 2016, Provisional application No. 62/308,520 filed Mar. 15, 2016 and, The disclosures of application Ser. No. 13/398,243 filed Feb. 16, 2012, Provisional application No. 61/628,044 filed Oct. 24, 2011, Provisional application No. 61/629,442 filed Nov. 18, 2011, Application Ser. No. 12/231,875, filed Sep. 8, 2008 and application Ser. No. 12/456,707 filed Jun. 22, 2009 now U.S. Pat. No. 8,161,699, are hereby incorporated by reference, including all drawings and all the specifications are hereby incorporated by reference in their entities into this US Patent Application.

FEDERALLY SPONSORED RESEARCH OR DEVELOPMENT

Not applicable

PARTIES OR JOINT RESEARCH

Not applicable

FIELD OF THE INVENTION

The present invention describes spacing-bracing members intersection the metal framing members where in metal framing member has protrusions that extend into the hole of the metal framing member restricting the vertical and or horizontal movement of the spacing-bracing member within the hole of the metal framing members The protrusions reduces the size of the hole opening leaving a space between the bottom edge of the protrusion and the bottom edge of the hole for the spacing-bracing member room to fit under the protrusion. The width of the spacing-bracing restricts the horizontal movement to the side edges of the hole or lip notches or hole notches or other types of notches that restrict the spacer-brace from horizontal movement member and the protrusion restrict the vertical movement and other types of hole notches along with lip notches restrict the vertical movement. The vertical support of the protrusion allows various types of spacing-bracing member configurations to overlap or just fit below the protrusions, however many different spacer-brace configurations restrict the spacer-brace from moving horizontally as described throughout the application. The protrusion and alternative configurations between spacing-bracing members and double lip increases strength and the double lip notch increase friction between the spacing-bracing members and the support members. The bulges at the longitudinal walls with bulges notches when offset also increases the friction between members other means are used to connect the framing member together. The offset positioning or the diagonally positioning of bulge notches and with lip notches in the spacing-bracing member decreases the vertical movement at the support member.

BACKGROUND OF THE INVENTION

Spacing-bracing members have been typically connected to metal framing members by using fasteners. Over the years the properties of the metal for structural framing members have changed where the exterior surface of the metal is more abrasive allowing the connection between the horizontal bracing members and the vertical structural framing members to fit temporarily together. Fasteners have been the main means of connecting the spacing-bracing member that are usually installed vertically and the metal framing members being the structural component of a structural framing system

DESCRIPTION OF PRIOR ART

Typically metal framing member and horizontal bracing members have used fasteners to connect the framing members together. Prior art has made some improvements to restrict horizontal movement between metal framing members, however there has been no attempt to eliminate vertical movement.

SUMMARY OF THE INVENTION

The present invention shows adjacent spacing bracing members connected to support members by using notches indented into the spacing bracing member so the notches intersect and connect the hole side edges of a support member. The spacer braces connect to adjacent support members and intermediate support members by overlapping the ends of one spacer brace over another spacer brace with the notches of each spacer brace engaging the hole side edges of the support member. The spacer braces can be installed anywhere within the holes at the top, middle or bottom edge at the openings in the support member. The shape of the holes can vary from linear shape configurations to round and irregular shape holes. The spacer braces can have an end configuration where the spacer brace does not extend past the hole for example like an inside or outside corner of a building or a door or window opening. The holes in the support member can be flush with the web that is no protrusions or the hole can have the side edges a rims or ledges protruding from the side edges. The protrusions of the ledge are typically small as the ledge is used as a retainer to limit the vertical movement of the spacer brace crossing the hole as shown in the vertical support members of a building framing system. In the case of the ledge being a protrusion the spacing-bracing member is a notch that will receive the protruding ledge. The notches are shown as L-shaped notches where the ledge penetrates into the back edge or the short leg of the L-shaped notch while the initial opening has a longer leg that guides the ledge to the back of the notch. When overlapping two adjacent spacing bracing members together at the hole the lower notch fits deeper into the hole while the second spacing bracing member will fit over the first framing member. The size of the spacing member can very, that is a smaller size spacer brace is installed first and the larger spacer brace installed second assuming the U shape configuration upside down U. On the other hand when the spacer brace are the same width, the shape has a V shape that is the side of the U are flanges that are angled. When the sides two overlapping spacer braces having angled sides become tight to each other and the top of the U has a gap. With the shape consisting of a web with two adjacent flanges, the space or gap is between the two adjoining webs. Different spacing bracing members are shown with many different configurations as well as the shape of the holes and whether the spacing bracing member is right-side-up or up-side-down.

The support member has notches in the hole of the support member to eliminate vertical movement between spacer braces and the notches in the spacer braces eliminate any horizontal and lateral movement between the spacer braces and support members. The back edge of the holes notches keep the spacer brace from moving horizontally as well as the flanges if fitting tightly against the hole side edges. The curvilinear shape of the flanges or the bulges allow for a tighter fit against the hole side edges as well as the bulges having notches and the hole has notches at the bulges. As stated the notches in the perimeter of the hole can be narrow only having the thickness of the lip. On the other hand the perimeter notches can be large where the entire spacer brace can fit into allowing the top edge of the notch to be a protrusion that extends deep enough to accommodate two spacer braces where the first end of the first spacer brace overlaps a second spacer brace at the second end meet with the notches connect to the support member aperture. The top edge of the perimeter notch or protrusion can be canted so that two spacer braces will fit tight against the back edge of the perimeter notch. The longitudinal end notches in the spacer braces keep the spacer braces from moving laterally between support member and the back edge of the notches stabilize the spacer brace from moving horizontally. The vertical notches in the support member keep the spacer brace from moving vertically within the hole. The configurations of the spacer brace and the configuration of the hole in the support member overlap at the lateral ends and connected to each other while also being connected to the support member. The adjacent spacer braces can have the same configuration or different configurations. Sometimes the configurations like the U shaped spacer brace or the reverse lip spacer brace can appear similar, however when intersecting each other at the hole in the support members the size of the components such as the web, flanges and lips will vary in width in order for the spacer braces to fit together.

The longitudinal ends of the spacer braces can have the same end configurations or have different configurations to overlap one another at the end configurations of the spacer brace. For example a spacer brace having a notched tab end can fit over or under an adjoining spacer brace having only lip notches; or a notched tab end connects to an adjoining spacer brace have a finger end with a tab: or a spacer brace having a finger end connected to an adjoining spacer brace having lip notches; or a spacer brace having lip notches and a receiver slot hole connected to an adjoining spacer brace having a hook tongue tor connection to the receiver slot hole; or the spacer braces can be reversed with the lips having lip notches engaging the notched tab extension; or the spacer brace with a notched tab extension at the web is inserted between the smaller sized hole attached to the larger sized hole; or the spacer brace has a hook tongue at the web end where the hook tongue can be oriented upwards to attach a supporting plate to the support member can secure two intersecting spacer braces; or flange notches secured at the hole bottom edge can be connected to the hooked tongue extending into the receiver slot hole; or protruding hole side edges having notches can secure a spacer brace with or without lips to the support member when the adjacent spacer brace has a hook tongue extending into the receiver slot hole; or hook fingers being extended into hole notches where the longitudinal ends of the flanges or longitudinal ends of the lips secure the hook finger of the spacer brace with the adjoining spacer brace being connected by a hook tongue extending into the receiver slot hole; or two adjoining spacer braces having a continuous web flange inserted into the hole bottom edge allowing one spacer brace to overlap an adjoining spacer brace either by having a larger width web nestled into a smaller width web or by having the hole bottom edge extend further into and through the upper spacer brace; or by adding web extensions at both ends where one end has a receiver hole and the opposing end has a hook tongue with an obstruction end to restrict vertical movement. The same configurations of overlapping a hook finger into a receiver slot hole can also be incorporated into full width spacer braces having the width equal the width of the support member. When the hole side edges have different orientations or angular sides the spacer brace configuration can be different as each flange can have a web-flange notch in each flange where the web-flange notch extends into the hole side edges and when the hole side edges have hole notches the spacer brace will also not have any horizontal and vertical movement. The layering of two adjoining spacer braces by overlapping the end configurations and installing hole notches at the sides or large notches where the entire spacer brace extends under the protrusions extending over the spacer brace to eliminate the vertical movement between spacer braces and the support members.

The lip notches can be wider when the support member intersects a U shaped floor spacer brace having the lips with lip extensions are bent inward toward the opposing flange of the U shaped floor spacer brace and where the lip notches engage the support member and the lip notches are off set and the web has a raised web with a web notch also having the ends of said web notches off set for the support member web to be inserted into the raised web notches and the support member fitting into the wide lip notches and notches extensions then into the raised web notch for the support member flange.

BRIEF DESCRIPTION OF THE DRAWINGS

FIG. 15 shows a similar isometric view of FIG. 13 however the flange and lip form obtuse angles.

FIG. 38 shows the first reverse lip spacer brace having a notch at the web and angular flanges with flange-notches at the opposing ends. FIGS. 39 & 40 show the second overlapping reverse lip spacer brace installed slightly higher from the vertex with a gap between the vertex of the first and second reverse lip spacer brace.

FIG. 44 shows two same sized V shaped spacer braces 199 & 199' being overlapped and fitting snuggly together.

DESCRIPTION

Figure 1:
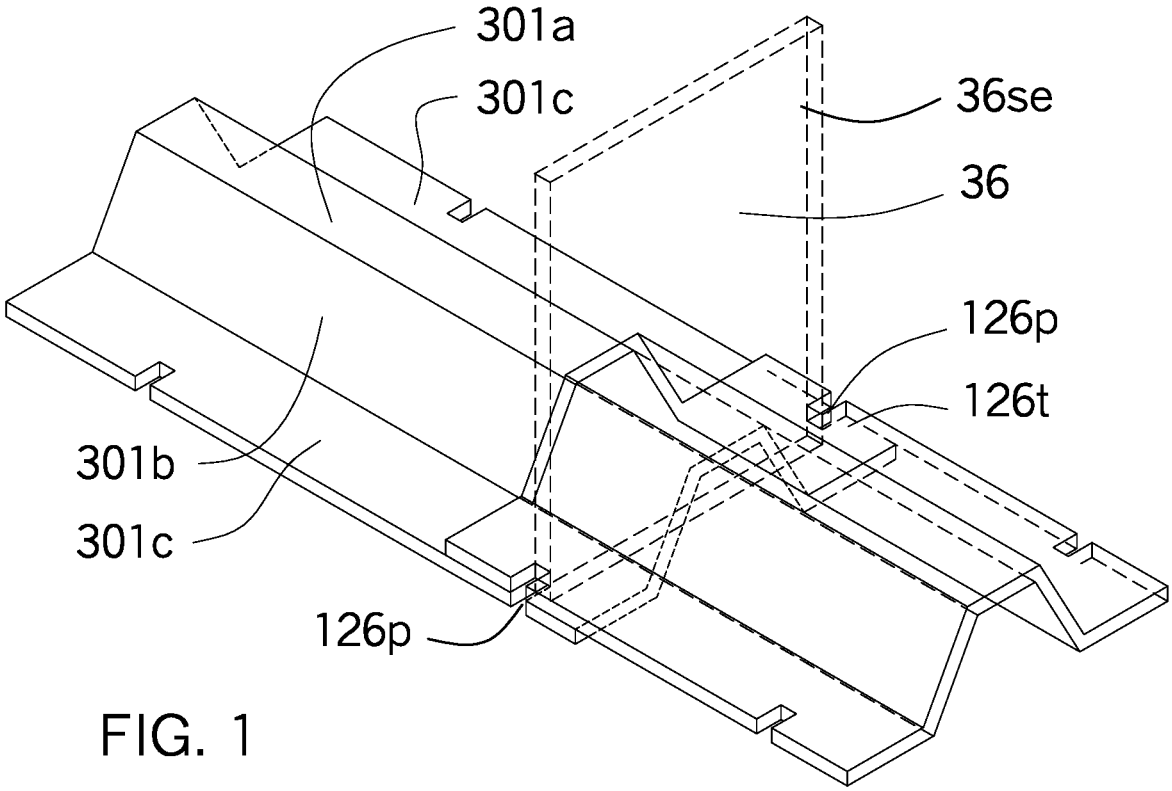
FIG. 1 shows an upward oriented U shaped reverse lip spacer brace connecting adjacent support members and overlapping an adjacent spacer brace connecting lip notches to the support members at the holes.

FIG. 1 shows a reverse lip spacer brace 301 having a web 301*a* with flanges extending vertically approximately coplanar to the holes side edges 36*se* with lips 301*c* having doubp notches 126*p* and where an adjoining second reverse lip spacer brace 301 overlaps the first reverse lip spacer brace 301 In order to overlap each other the reverse lip spacer braces 301 the width of the web 301*a*, the length of the flanges 301*b* or the lips 301*c* will vary depending on shape and snugness between reverse lip spacer braces 301. This continuation in part application shows the hole notches 126*h* at the hole side edges 36*se*, but is only shown at the furthers left hole rather than all the holes 36 in the support member for clarification purposes. The lip notches 126*p* at the left support member show the lips 301*c* with the lip notches 126*p* shorter while the hole notches 126*h* have a deeper depth so the lip notches 126*p* will extend deeper into the hole notch therefore eliminating any vertical and horizontal movement within the hole notch 126*h*. All the holes 36 can have hole notches 126*h* to eliminate vertical movement at the holes 36 or may be installed at the hole side edges 36*se* without the hole notch 126*h*. At the right no hole notches 126*h* are shown as the hole notches 126*h* can be a double lip notch 126*dp* or a double hole notch 126*dh*. If the hole notch 126*h* is wide enough for only one lip notch 126*p* the lower reverse lip spacer braces 301 would have its lip notch 126*p* not fit into the hole notch 126*h* and only the upper reverse lip spacer brace at the lip notch 126*p* would only engage the hole notch 126*h* keeping the lower spacer brace 301 tight against the hole bottom edge 36*be*. The width of upper oriented spacer brace has a narrower width web 301 with longer flanges 301*b* and longer lips 201*c* to fit into the lower reverse lip spacer brace 301.

Figure 2:
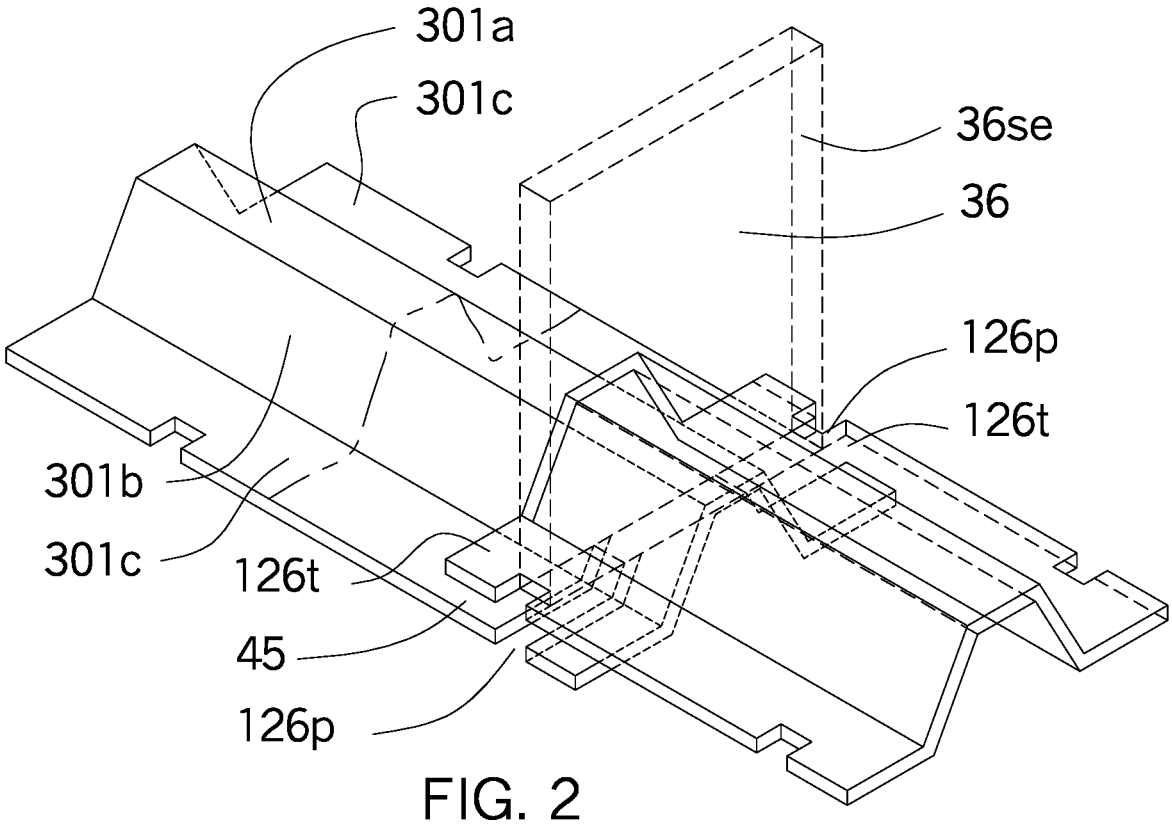
FIG. 2 shows an upward oriented U shaped reverse lip spacer brace having angular flanges connecting adjacent support members and overlapping an adjacent spacer brace connecting the lip notches to the support members at the holes.

FIG. 2 is similar to FIG. 1 except the flanges 301*b* are angular allowing two overlapping reverse lip spacer braces 301 to fit against each other. The web 301*a*, flanges 301*b* and lips dimensions can vary depending how the upper reverse lip spacer brace 301 wants to fit into the lower reverse lip spacer brace 301 or under the hole bottom edge should a hole notch be available at the hole. The hole notches 126*h* can be a double hole notch 126*dh* and the lips 301*c* can be double requiring a double lip notch 126*dp* as for FIG. 1.

Figure 3:
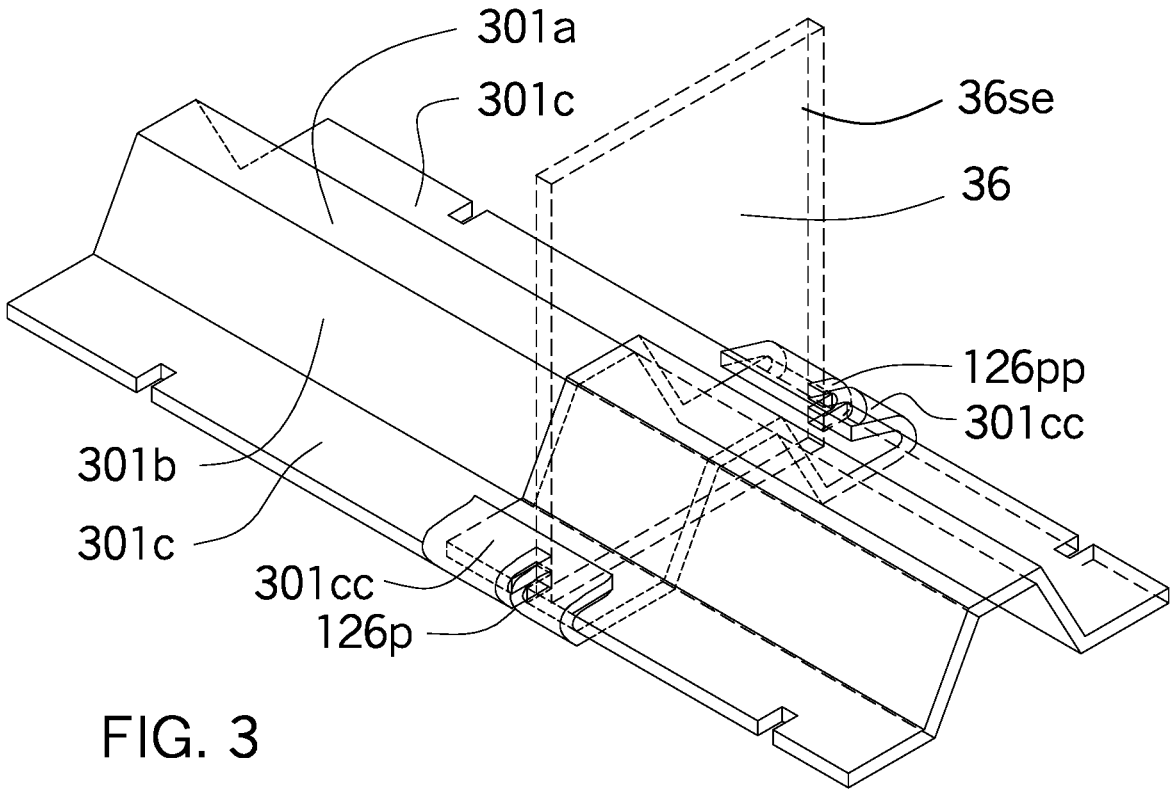
FIG. 3 is similar to FIG. 1 however the first reverse lip spacer brace entering the hole at the support member has a wider lip with a lip notch or a double lip notch having a space between the lip and lip extension can for the opposing end of an adjacent reverse lip spacer brace having a smaller width lip with lip notches to extend between the double lip notches.

FIG. 3 like FIGS. 1 & 2 does not show a gap 45 between the lips 301*c* because the web 301*a* is narrower, the flanges 301*b* are longer in length and the lips 301*c* are wider in width as the longitudinal edges of the lips 301*c* are shown aligned. The wider reverse lip spacer brace 301 is shown having a double lip 301*cc* with a double lip notch 126*cc* at the second end of wider reverse lip notch 301 for another reverse lip spacer brace 301 having a wider web to overlap the first end of the wide width reverse lip spacer brace and where the lip 301*c* with the lip notches 126*p* fit into the space between the lip and the lip extension where the bend of the double lip notch is located. The reverse lip spacer brace can have a double lip configuration the entire length with the second end being a reverse lip spacer brace 301 with notched lips when overlapping the first end of the adjacent double lip reverse lip spacer brace having notches.

Figure 4:
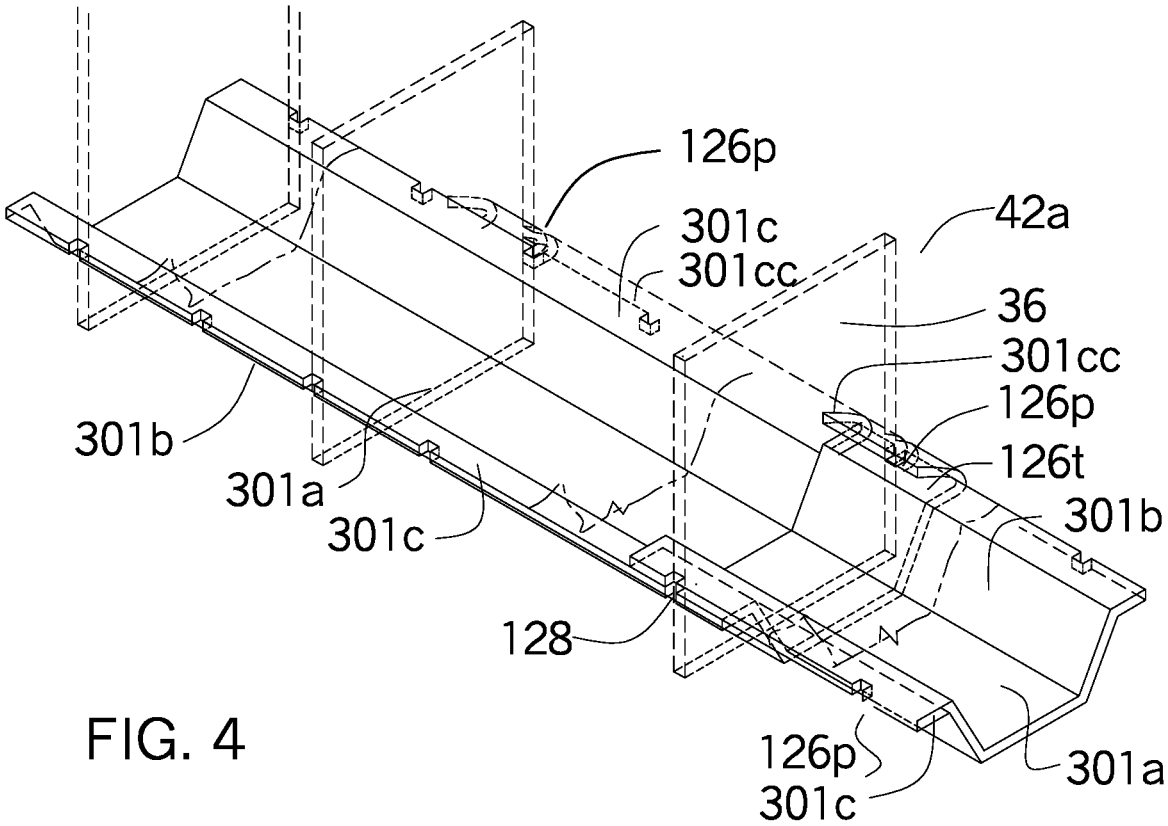
FIG. 4 shows a downward oriented U shaped reverse lip spacer brace have lips extending from the flanges have lip notches overlapping an identical adjacent spacer brace connected at the lip notches to the holes of a support member.

FIG. 4 is similar to FIG. 2 except the two overlapping reverse lip spacer braces 301 is shown face down with the left reverse lip spacer brace 301 having the lips 301*c* supported by the hole bottom edge 30*be*. The lips 301*c* have lip notches 126*p* that extend inward from the longitudinal edge of the lips 301*c* so the web 42*a* of the support member fits against the back edge of the lip notches 126*p* with the side edges of the lip notch 126*p* abut both side planes of the web 42*a* of the support member. The second reverse lip spacer brace 301 also extends through the hole 36 overlapping the first reverse lip spacer brace 301 at a slight angle, in order to have the longitudinal edges of the lips 301*c* fit through the hole 36 and have the back edge of the lip notches 126*p* engage the hole side edges 36*se*. As in FIG. 1 the width of the web 301*a* and the width of the flanges 301*b* and lips 301*c* will be wider in order to have both reverse lip spacer braces 301 fit tightly together and may have fasteners (not shown) to additionally secure the reverse lip spacer braces 301 together. As discussed earlier hole notches 126*h* may be installed at the hole side edges 36*se* either as a single notched hole 126*h* or as a double wide notched hole 126*dh*. The hole configuration shows a hole protrusion 36*p* that extends from the left hole side edge 36*se* and a right hole side edge 36*se* from the right hole side edge 36*se* and both hole protrusions 36*p* extending from the hole top edge 36*te* with a hole gap 45*h* between and ending short of the hole bottom edge 36*be* leaving an open space between. The corner of the protrusions 36*p* at the hole gap 45*h* fit into a flange slot holes 36*fs* at the sloping flanges 301*b* with the hole protrusions 36*p* have a protrusion nodule 36*pn* extending into the hole gap 45*h*.

Figure 5:
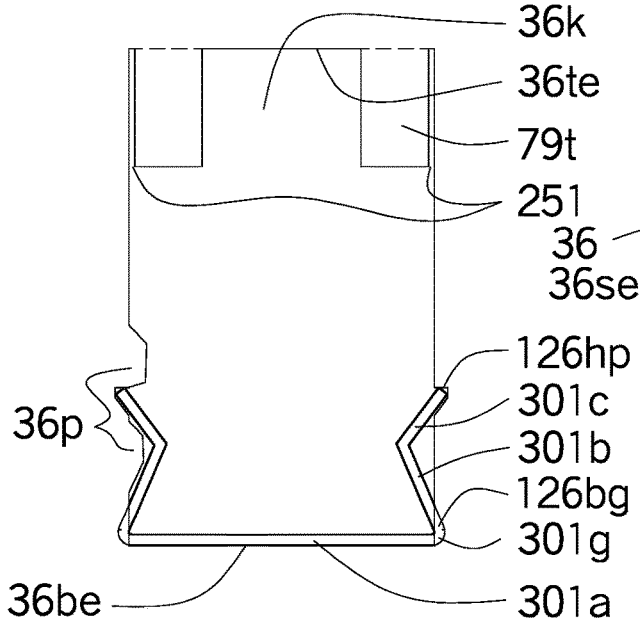
FIG. 5-7 shows how the hole side edges or protrusions can extend into the hole side edges to form other spacer brace configurations. The figures show how the bulges between the web and the flanges can create an indentation to secure the spacer brace into the hole side edges or how the bulges can have an indentation or notch to slide within the hole side edges and how the flanges can be bent and the lip also bent to create a different configuration of the spacer brace.
Figure 6:
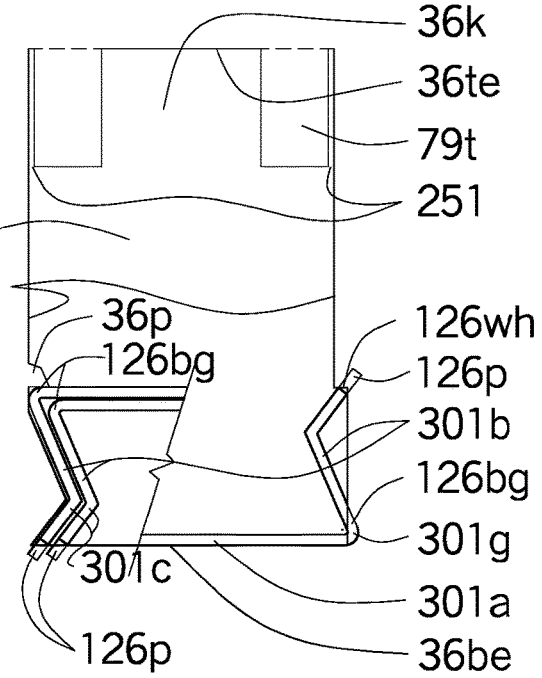
Figure 7:
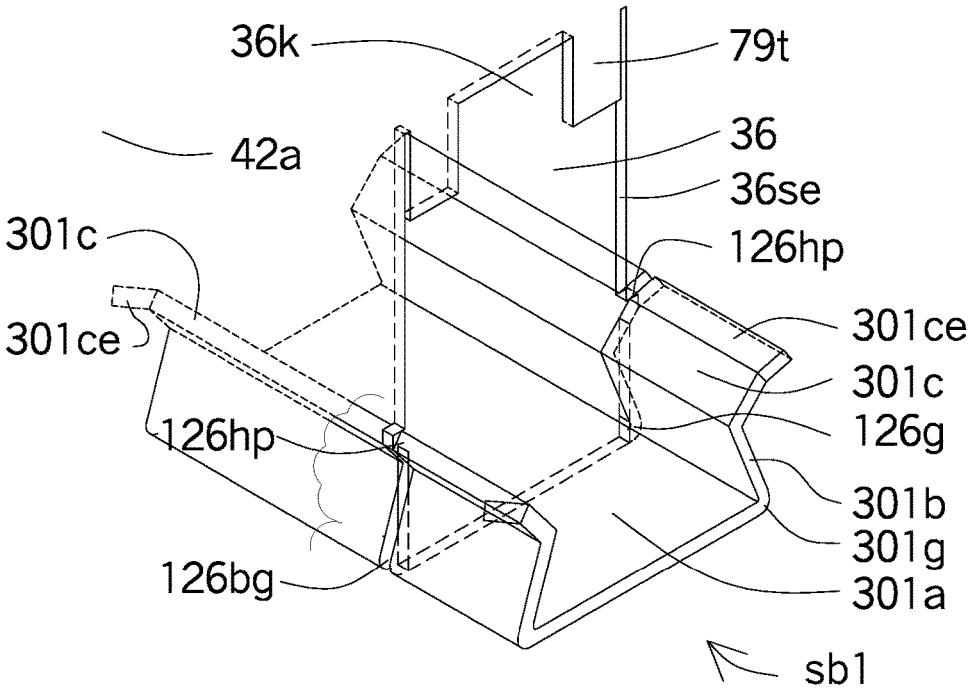
Figure 8:
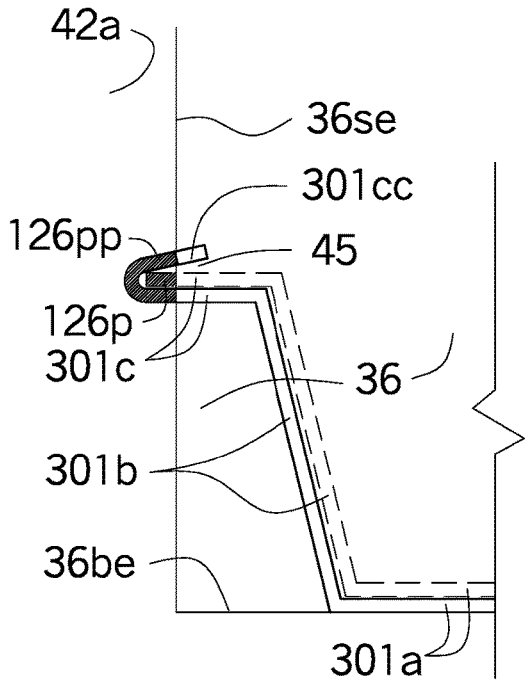
FIG. 8-9 show a longitudinal cross section of a spacer brace and FIG. 15 shows a cross section of the reverse lip spacer brace, except here the lip has a double lip where the double lip extends upward and the lip notches are at the side edges of the lip notches the engage the web of the support member above the hole notches.
Figure 9:
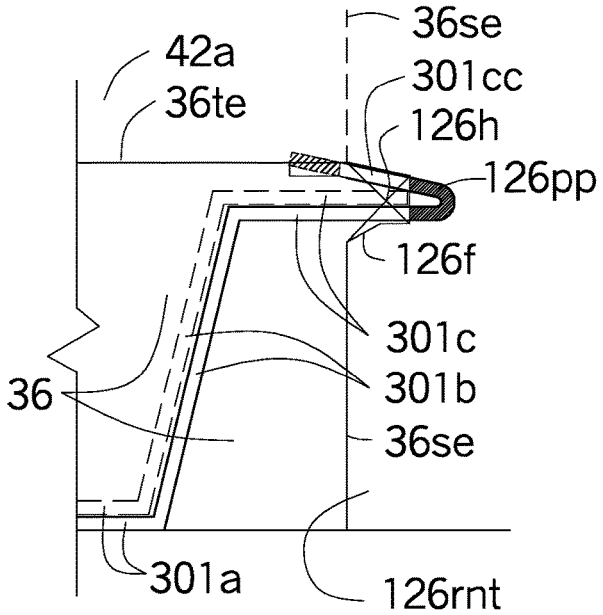
Figure 10:
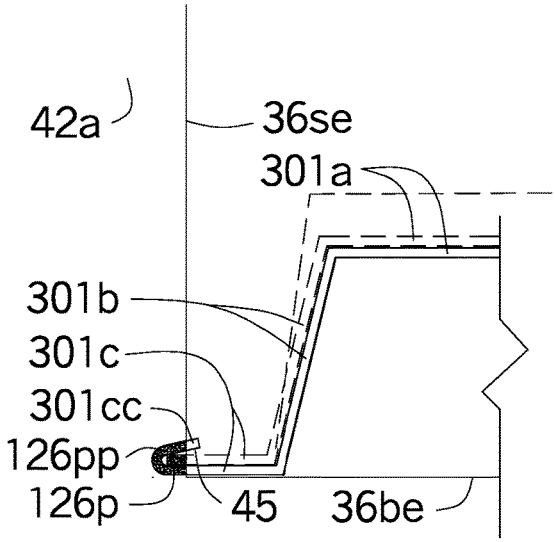
FIG. 10-11 shows the double lip with the free edge facing downward and the lip notches engage the bottom edge of the hole notches.
Figure 17:
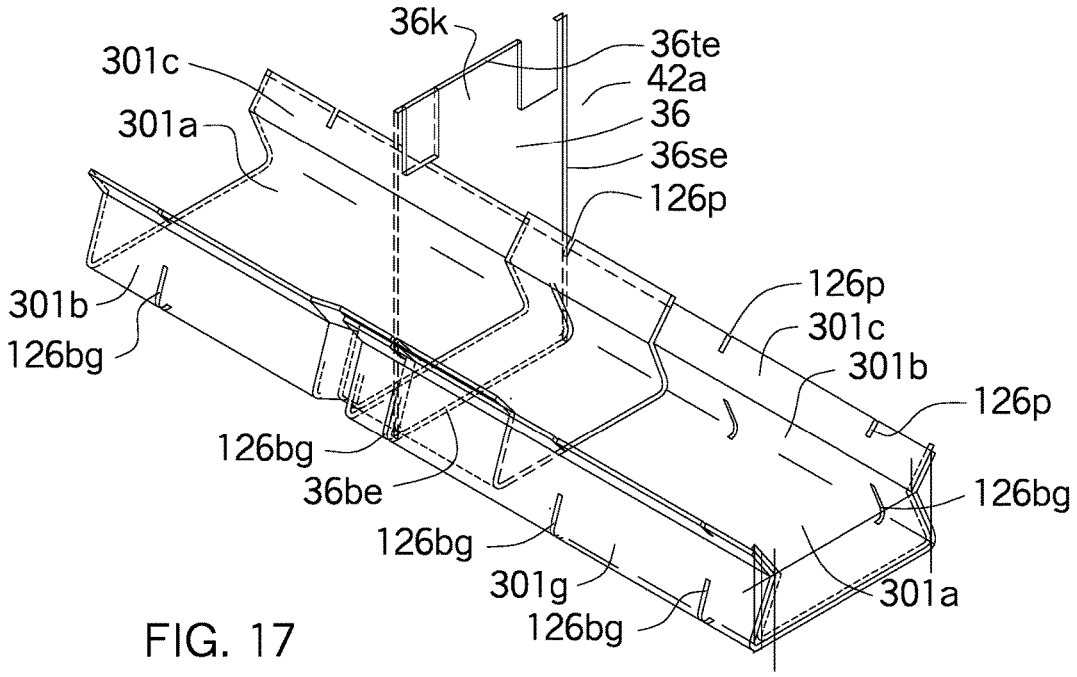
FIG. 17 shows an isometric view of FIG. 15.
Figure 38:
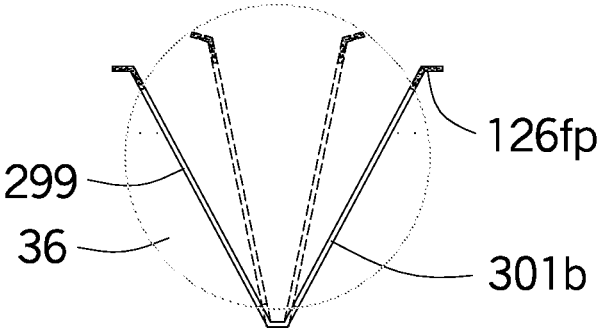

FIGS. 5-7 show two hole elevations and FIG. 7 shows an isometric view similar to the reverse lip spacer brace 301 shown in FIG. 17. An irregular shaped reverse lip spacer brace 301 is shown having the plane of the web 301*a* resting on the hole bottom edge 36*be* with the side planes extending upward at an angle sloping inward at an acute angle forming a bulge 301*g* at their intersection. The bulge 301*g* can be formed to have a bulge notch 126*g* where the web 301*a* and a portion of the flange 301*b* have a combined notch referred to as a bulge notch 126*g* or the bulge 301*g* has no notch at all. The longitudinal edge of the flanges 301*b* have lips 301*c* that bend outward toward the hole side edge 36*se* as shown in FIG. 5. The free edge of the lip 301*c* abuts a hole protrusion 36*p* as shown on the left hole side edge 36*se* or indented shown as a lip hole notch 126*hp*. The structural integrity of the hole 36 should be at the furthest indentation at the lip hole notch 126*hp*. The left side of the hole side edge 36*se* in FIG. 6 shows an inverted reverse lip spacer brace 301 with the hole side edge 36*se* having the same flange 301*b* and lip 301*c* configuration along with the lip notches 126*p* at the distal longitudinal edges of the lip 301*c*. On the right hole side edge 36*se* is described in FIG. 17. By having the left side inverted, the web 301*a* have both the longitudinal sides extending downward and the flange-bulges 126*fg* at the corner of the flanges 301*b* and the web 301*a* and are braced by hole protrusions 36*p* that extend above the web 301*a*. The longitudinal sides have lips 301*c* extending the length of the flanges 301*b* with lip notches 126*p* extending inward from the free edges to engage the hole side edges 36*se*. The angled flanges 301*b* and lips 301*c* are the same on both the left and right sides of the holes 36. When the flanges 301*b*, 302*b* are oriented vertically and the web 301*a*, 302*a* is resting on the hole bottom edge 36*be* the wider spacer brace 301, 302 will be installed first with smaller spacer brace 301, 302 profile is nestled into the wider spacer brace. On the other hand when the flanges engage the hole bottom end 36*be* then the smaller profile of the spacer brace 301, 302*a* will be installed first with the wider profile overlapping the smaller profile. The wider reverse lip spacer brace 301 on the left side is held in place at the lip notches 126*p* extending around both the hole side edge 36*se* planes of the hole bottom edge of the hole 36. The inner reverse lip spacer brace 301 is install first within the hole 36 with the smaller profile with the lip notches 126*p* engaging the hole bottom edge 36*be*. The web 42*a* and the web 301*a* has its top plane fitting under the hole protrusion 36*p* keeping the reverse lip spacer brace 301 secured within the hole 36. In the isometric view FIG. 7 38 shows an extended lip 301*ce* that is also angled. The extended lip 301*ce* has the lip notch 126*p* extending inward from the free edge of the extended lip 301*ce*.

Figure 11:
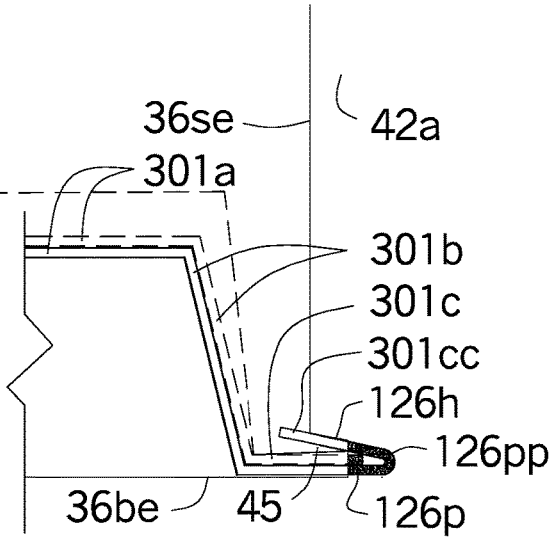

FIGS. 8-11. show a longitudinal cross section of a reverse lip spacer brace 301 having a web 301*a* with a flange 301*b* attached to each side edge of the web 301*a* and extending away from the web 301*a* having a first flange 301*b* and second flange 301*b* with a lip 301*c* extending outward away for the first and second flanges 301*b* and where the lips 301*c* extending further forming a lip extension 301*cc* extending in the opposite direction forming an acute angle with a space between the lip extension 301*cc* and the lip 301*c* where a curvilinear shape double lip notch 126*pp* occurs at the first lip 301*c* and the second lip 301*c* with the double lip notch 126*pp* extending into the perimeter of the aperture 36 or into perimeter notches at the perimeter side edges of the aperture of the support member 42 and double lip notches 126*pp* and into the aperture 36 of intermediate support members 42 with the double lip notches 126*pp* are offset or skewed at an angle to create friction between the double lip notches 126*pp* and the web 42*a* as shown in FIGS. 3 and 4. FIG. 4 shows the reverse lip spacer brace 301 being full length with the lips and where the lip notches are setback from the second end where the lip notches are indented at the perimeter side edges of the aperture and overlap the first reverse lip spacer brace having the double lip notch 126*pp* already engaged into the perimeter of the same aperture 36. The reverse lip spacer brace 301 shown in ghost in FIG. 4 and FIGS. 8-11 where the reverse lip spacer brace has the double lip notch 126*pp* extends the full length of the reverse lip spacer brace 301 with the second end have lips 301*c* with lip notches extend into the V-shape space between the lip 301*c* and the lip extension 301*cc*. When the double lip notch 126*pp* is short and having a small acute angle the lip notch 126*p* cannot extending into the aperture side edges of the support member, on the other hand when the lip extension has a larger acute angle or the double lip notch 126*pp* is more curvilinear the lip notch 126*p* easily extends into the double lip notch 126*pp* and engage the aperture 36 of the support member 42 as shown in FIG. 11. FIG. 11 shows a perimeter notch that is indented into the aperture 36 of the support member 42. The lip notches 126*p* and the double lip notches 126*pp* are offset to each other forming uneven surfaces for maximum friction between reverse lip spacer braces 301 and the perimeter of the aperture 36 in the support member 42. The reverse lip spacer brace 301 with lip notches 126*p* is installed into the V shape of the lip notches.

Figure 12:
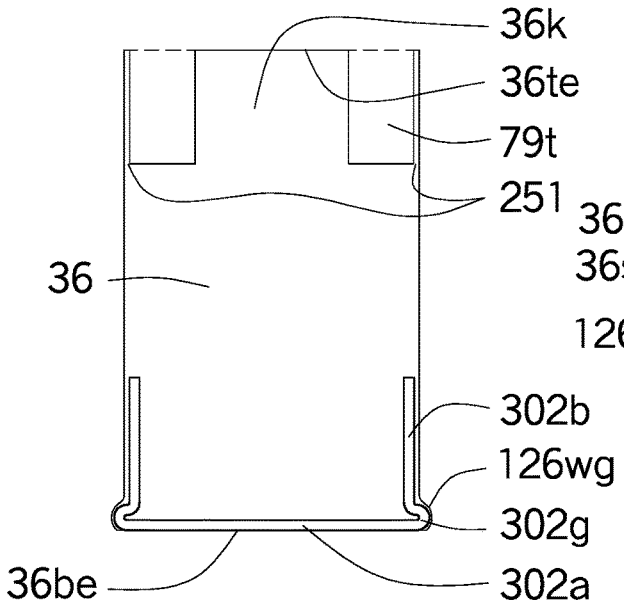
FIG. 12 shows the bulge of the spacer brace insert into the hole notch at the lower corners of the hole in the support member.

FIG. 12 shows a U shaped spacer brace 302 has bulges 302*g* extending outward from the web 302*a* forming a half-circle shape then upward forming the flange 302*b*. The half-circle shape of the bulge 302*g* corresponds to the half-circle shape of the web-bulge notch 126*wg* for the bulge 302*g* to fit into. The bulge notches 126*wg* can vary in size where large curvilinear shapes can fit into as shown in FIG. 12-17 and FIG. 27. The bulges 302*g* can be used without the bulge notches 126*wg*. The bulges 302*g* can fit tight against the hole side edge 36*se* to create as must friction as possible as the web 302*a*, as the web 302*a* will bend as well as the flanges 302*b* to form a tight frictional connection at the bulges 302*b*.

Figure 13:
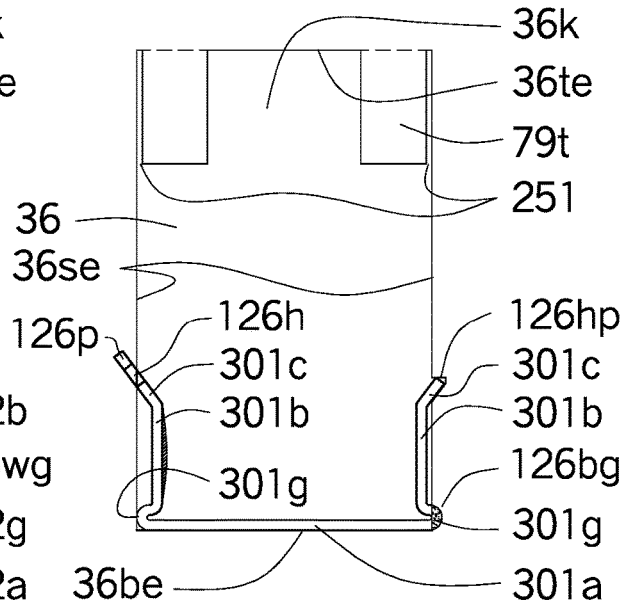
FIG. 13 shows the bulge having a bulge notch where the side edge hole fits into and the lip of the space brace fits into the hole notch of the web in the support member.
Figure 27:
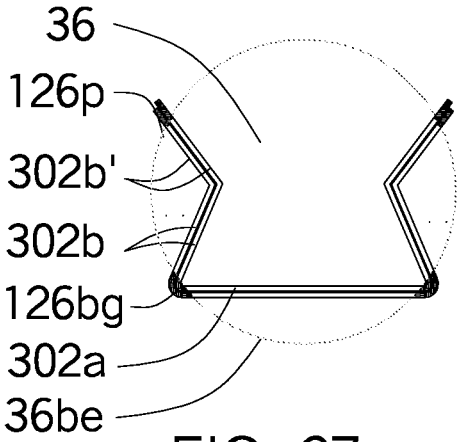
FIGS. 27-30 shows the reverse lip spacer brace having bent flanges and installed with the flanges extending upward or downward within the rectilinear hole.

FIG. 13 is similar to FIG. 13-17 except the spacer brace is a reverse lip spacer brace 301 having a bulge 301*g* at the intersection of the web 301*a* at the first longitudinal flange 301*b* and the second longitudinal flange 301*b* having a half-circle shape. If the bulge 301*g* at the left side of the aperture has the bulge 301*g* fitting against the side edge of the aperture and fitting tight against the right side edge of the aperture the web 301*a* would flex away from the bottom edge of the aperture, then the bulges 301*g* would exert pressure against the aperture side edges provide enough resistance to the hole side edges 36*se* from moving vertically within the aperture. The bulge 301*g* has a counter bend allowing the first and second longitudinal flanges to extend upward toward the hole top edge 36*te* with the first and second longitudinal flanges 301*b* having lips 301*c* extending diagonally toward the hole side edges 36*se* with the angular lip with the lip notches 126*p* engaging the hole side edge 36*se* creating a resistance against the hole side edge 36*se*. The hole side edges 36*se* shows an angular perimeter notch 126*p*. If the lip notch 126*p* are longer the lip notch 126*p* the lip notch 126*p* will fit tight to the back side edge of the hole notch 126 causing the longitudinal flanges 302*b* to bend and form such a snug fit that I needed plyers to compress the flanges together to remove the lip notches 126*p* from the hole notches. On the right side the reverse lip spacer brace is similar, however the bulge notches 301*g* has the same configuration as the left bugle 301*g* except the right bulge 301*g* has a bulge notch 126*bg* that is an indentation in the bulge 301*g* that typically aligns with the hole side edges 36*se* where the back edge of the bulge notch 126*bg* are aligned. The bulge notches 126*bg* vary in size as shown in FIG. 27 where the bulges notches 126*bg* can be angular causing the hole side edge 36*se* to not be aligned therefore creating more friction in order for the reverse lip spacer brace 301 have the bulge 301*g* from sliding vertically within the aperture 30. In addition said bulge notch 126*bg* does not have to be aligned with said lip notch 126*p* the further out of alignment the more friction will exist between both notches and therefore less vertical movement with the aperture 36. The longitudinal flange at the right side of the holes side edge 36*se* shows a diagonal lip extending into a hole notch 126*h* or a hole protrusion 126*hp* with a diagonal lip. Since the bulge 301*g* has hole protrusion notches 126*hp* a lip notch 126*p* is not shown, but could be added for additional strength. The hole lip notch 126*hp* is shown having a sloped bottom edge for an easy access into the hole lip notch 126*hp* to provide additional resistance to the reverse lip spacer brace 301

Figure 14:
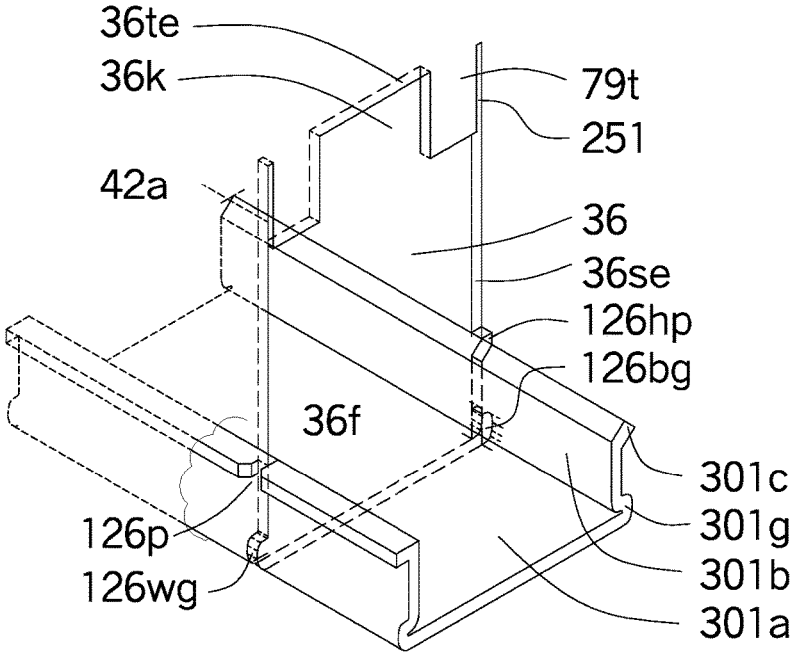
FIG. 14 shows an isometric view of FIG. 13 where the bulge notch fit into the side edge of the hole and the lip from the spacer brace fits into the hole notch of the web in the support member.

FIG. 14 shows a reverse lip spacer brace 301 having a web 301*a* with bulges 301*g* at each intersection of the flanges 301*b* with the left side having a horizontal oriented lip 301*c* and the right side having an angular oriented lip 301*c*. The bulges 302*g* can be installed on the left hole side edge 36*se* at the bottom corner has a web-bulge notch 126*wg* as shown in FIG. 13 for the bulge 301*g* to fit into and the left lip 301*c* has a lip notch 126*p* for the hole side edge 36*se* to fit into. The right side would typically have the same above described combination of self-locking connections on the opposing side of the reverse lip spacer brace 301. Another combination of self-locking connection is shown on the right side which is the same combination as shown in FIG. 14.

Figure 15:
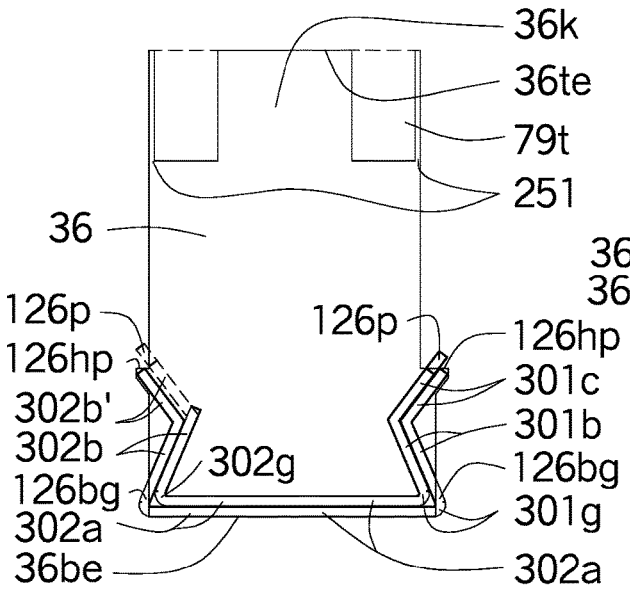
Figure 16:
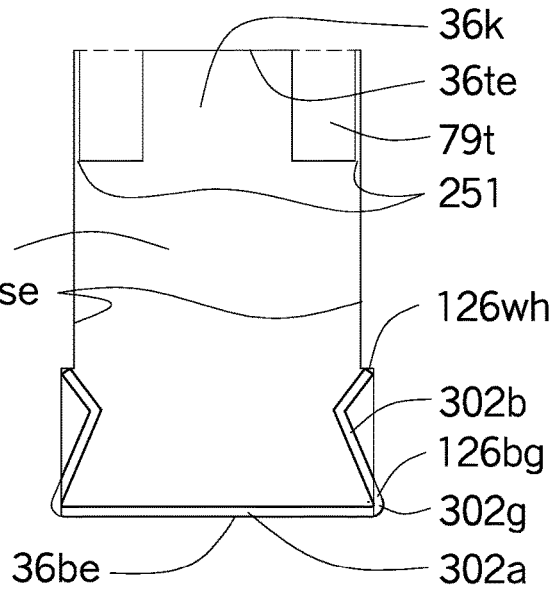
FIG. 16 shows the same isometric view of the spacer brace 15 except the side-edges of the hole are inserted to the depth of the back of the notch allowing the spacer brace to be inserted into the deeper side-edges of the hole.

FIGS. 15-17 show a U shaped spacer brace 302 is similar to the U shaped spacer brace 302 shown in FIGS. 12-14 where a web 302*a* has bulges 302*g* on both sides having flanges 302*b* extending ventrally inward forming an acute angle from the web 302*a* then bending outward into a hole 36 in the support member with a hole notch 126*h* at the hole side edges 36*se* of the aperture 36. The flanges 302*b* show a bulge 302*g* where the bulges 302*g* are wider than the size of the whole 36 and where a bulge notch 126*g* is formed to engage the whole side edges 36*se* at both whole side edges 36*se*. The spacer brace could be considered a U shaped spacer brace 302, this is the flange 302*b* has could be considered having multiple flanges 302*b* and 302*b*' or be referred to as a reverse lip spacer brace 301 where the flange 301*b* is the acute angled flange 301*b* and the other angled member is a lip 301*c*. At the right hole side edge 36*se* shows the U shaped spacer brace 302 having a longer flange 302*b* In FIG. 15 the reverse lip spacer brace 301 passes through the hole 36 so the bulge notches 126*bg* intersect the hole side edges 36*se* having a hole lip notch 126*hp* and a hole notch 126*h* and the longitudinal side edges of the lips 301*c* are inserted into the hole lip notches 126*hp* forming a self-locking connection with the hole 36. FIG. 16 has the same reverse lip spacer brace 301 along with the bulge notch 126*bg* at the bulge 301*g*. The hole lip notch 126*hp* is shown as a web notch 126*w* because the hole side edge 36*se* at the reverse lip spacer brace 301 is recessed rather than shown as a hole lip notch 126*hp*. The isometric in FIG. 17 has the same profile as FIG. 33 except a smaller profile for the U shaped spacer brace 302 where the left U shaped spacer brace has the flange 302*b* and ends before the flange 302*b* has a flange extension 302*fe* added. With only the flange 302*b* the smaller U shaped spacer brace 302 is secured by longitudinal friction created by having the flange 302*b* having acute angle at the web 302*a* and the friction resulting from the smaller profile flange 302*b* nestled into a larger flange profile having a smaller acute angle creating additional longitudinal and vertical friction between the two flanges 302*b* plus fasteners can connect the two flanges 302*b*. The left U shaped spacer brace 302 shows a flange extension 302*b*' at the smaller U shaped spacer brace 302 with a flange notch 126*f* (lip notch 126*p*) engaging the hole side edge 36*se*. The right U shaped spacer brace is shown with the flange extension 302*b*' as a reverse lip spacer brace 301 with a lip 126*c* and a lip notch 126*p* indented from the distal edge of the lip 301*c* and where the lip notch 126*p* connected to the hole lip notch 126*hp*.

Figure 18:
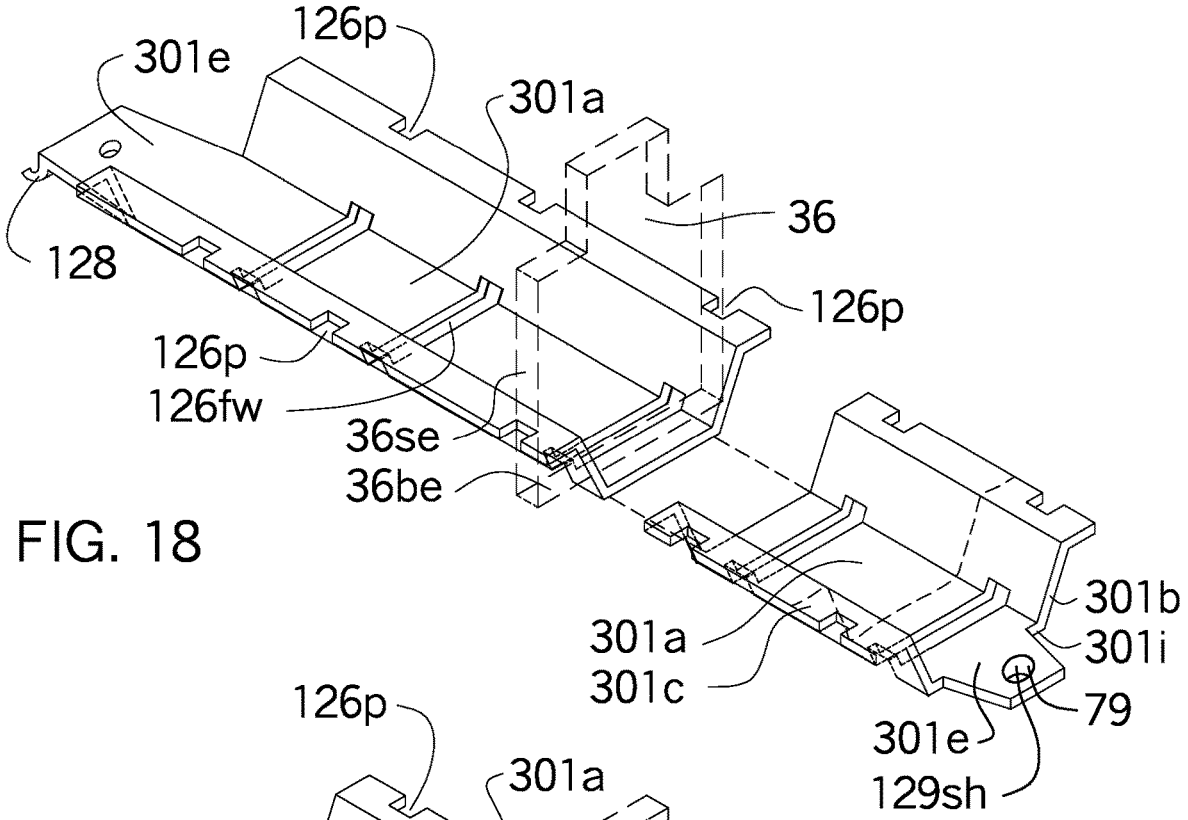
FIG. 18 shows two reverse lip spacer braces overlapping the hole bottom edge with a continuous web flange notch allowing the first reverse lip spacer brace to extend lower into the continuous web flange notch an adjacent spacer brace to overlap the first reverse lip spacer brace. Or using an alternate solution of having the hook tongue extend into a receiver slot hole.

FIGS. 18-21 are similar to each other as two reverse lip spacer braces 301 each having a web 301*a* with the longitudinal side edges distal to the flanges 301*b* where the longitudinal edges of the flanges 301*b* have lip 301*c* extending outward away from the web 301*a* with the lips 301*c* have lip notches 126*p* extending inward toward the web 301*a* from the longitudinal edges of the lips 301*c*. The first reverse lip spacer brace 301 shown at the right side of the hole 36 with the right longitudinal end extending into the hole 36 engaging the hole side edges 36*se* at the lip notches 126*p* and where the web 301*a* and the flanges 301*b* have continuous flange-web notches 126*fw*. The flange-web notch 126*fw* engages the hole bottom edge 36*be* so the back edge of the flange-web notch 126*fw* at the flanges 301*b* is secured to the hole bottom edge 36*be*. When the second reverse lip spacer brace 301 has the right longitudinal end fit into the hole 36 the flange-web notch 126*fw* from the first reverse lip spacer brace 301 fits lower into the hole bottom edge 36*be* allowing the second reverse lip spacer brace 301 at the right longitudinal end to overlap the first reverse lip spacer brace 301 as shown in FIG. 2. FIG. 18 also shows an alternative overlapping end connection solution where the right reverse lip spacer brace 301 has an extension 301*e* extend from the web 301*a* with a receiver slot hole 129*sh* having a ledge 79 extending down where the opposing end of an adjacent reverse lip spacer brace 301 having a hook tongue 128 with an extension 301*e* extending from the web 301*a* for the tongue end having a curvilinear end to wrap around the ledges 79 at the receiver slot hole 129*sh*.

Figure 19:
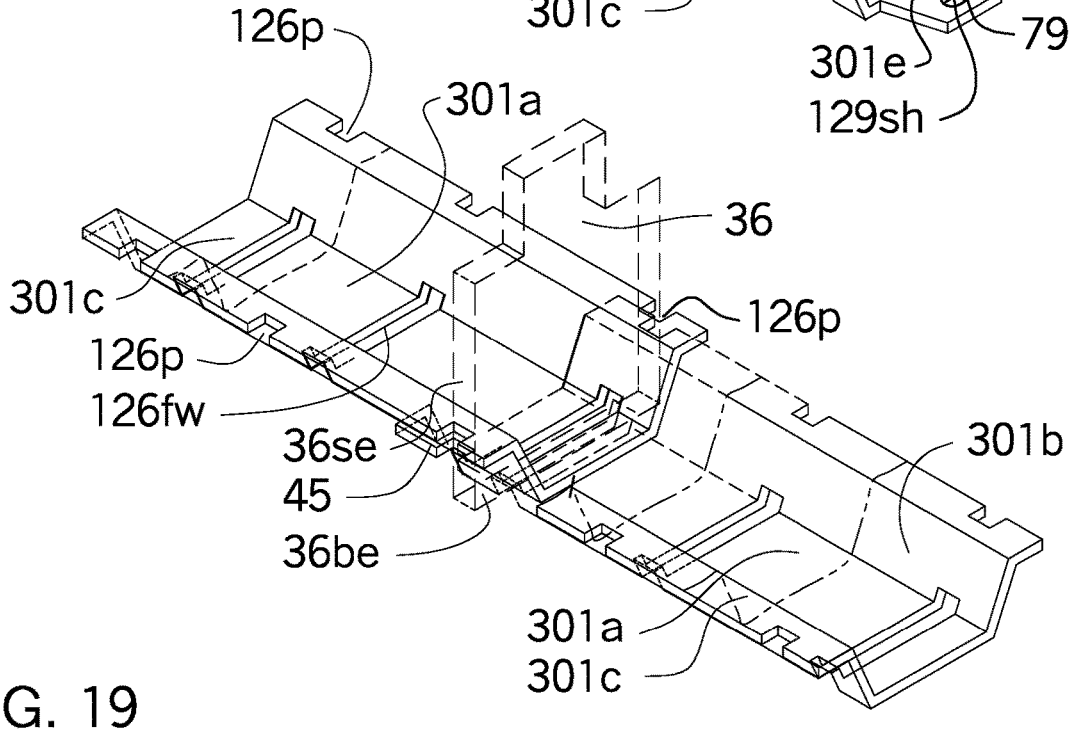
FIG. 19 shows the two reverse lip spacer braces overlapping and engaging the hole bottom edge as shown in FIG. 18.
Figure 20:
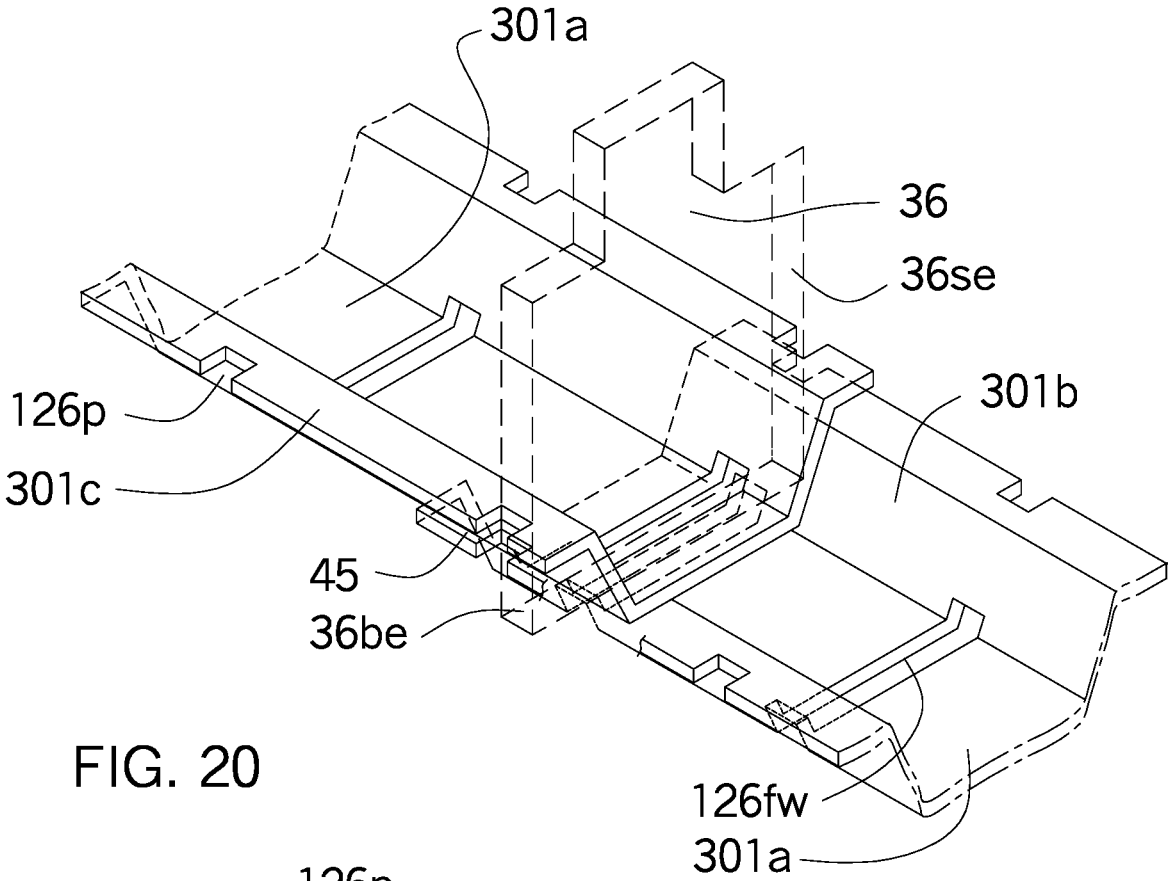
FIG. 20 shows and enlargement of FIG. 19.
Figure 21:
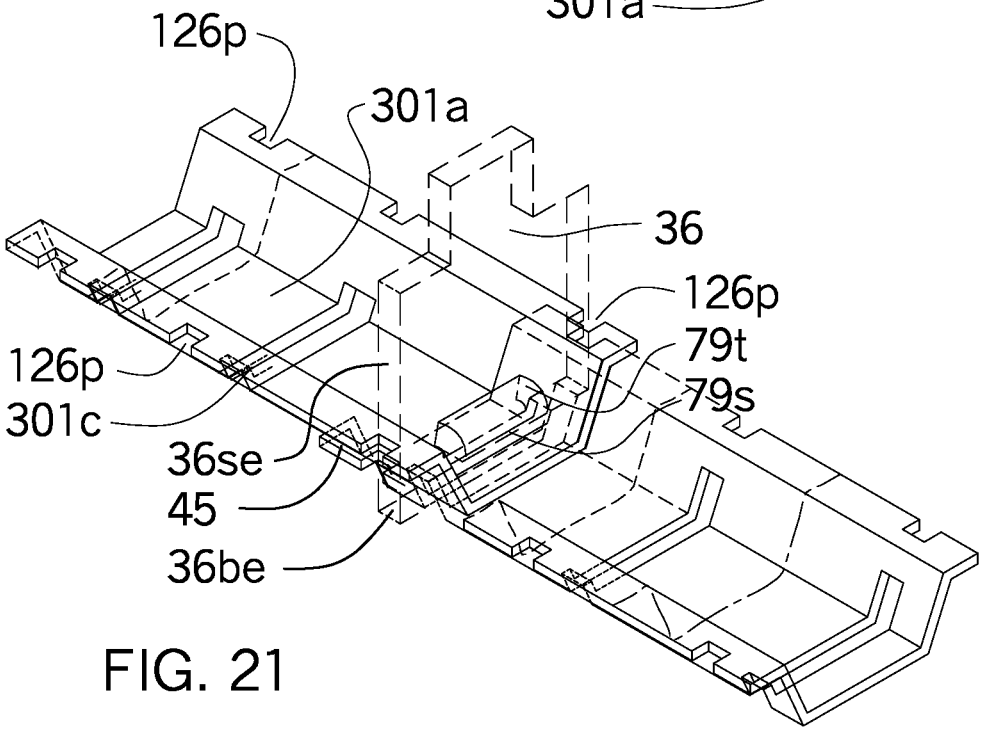
FIG. 21 shows a deeper web flange notches where the lower reverse lip spacer brace has a deeper flange for additional strength or allowing for the hole bottom edge to be longer for a different configuration or the deletion of the lips with notches.

FIG. 20 shows an enlargement of FIG. 19 where the first reverse lip spacer brace 301 has the hole bottom edge 36*be* being inserted into the flange-web notch 126*fw* where the web 301*a* is below the hole bottom edge 36*be* allowing the second reverse lip spacer brace also having the flange-web notch 126*fw* to also be inserted into the hole bottom edge 36*be*. In FIG. 21 the hole bottom edge 36*be* can now extend above the second overlapping reverse lip spacer brace 301 where a ledge shaft 79*s* with a ledge tab 79*t* is bent over the web 301*a* of the second overlapping reverse lip spacer brace 301 as well as the first reverse lip spacer brace 301 connecting both spacer braces together. In FIG. 21 shows the ledge tab 79*t* being bent over the web 302*a* of a U shaped spacer brace 302 as well as a notched tab 126*nt* being extended from the hole bottom edge 36*be*.

Figure 22:
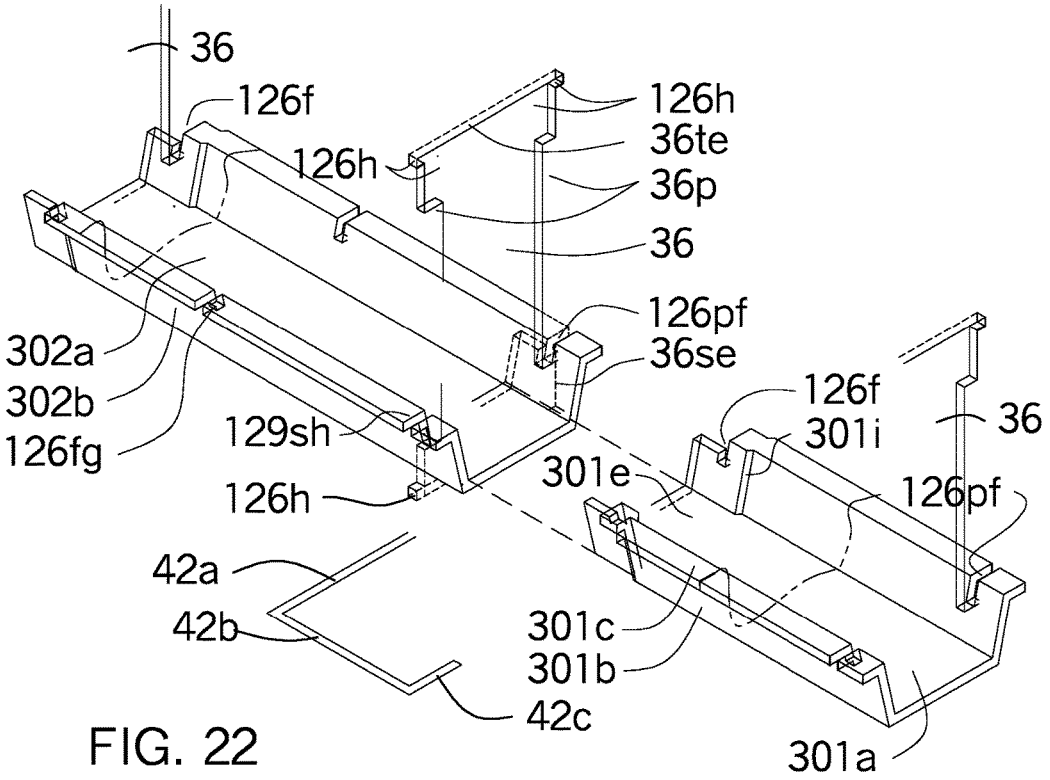
FIG. 22 shows an upward oriented U shaped reverse lip spacer brace connecting adjacent support members and overlapping an adjacent spacer brace connecting the lip notches to the support members at the holes.

FIG. 22 shows a reverse lip spacer brace 301 having a web 301*a* with flanges extending vertically approximately coplanar to the holes side edges 36*se* with lips 301*c* having lip notches 126*p* and where an adjoining second reverse lip spacer brace 301 overlaps the first reverse lip spacer brace 301. In order to overlap each other the reverse lip spacer braces 301 the width of the web 301*a*, the length of the flanges 301*b* or the lips 301*c* will vary depending on shape and snugness between reverse lip spacer braces 301. The hole notches 126*h* at the hole side edges 36*se* are shown at the left hole rather than all the holes 36 in the support member for clarification purposes. The lip notches 126*p* at the left support member show the lips 301*c* with the lip notches 126*p* shorter while the hole notches 126*h* have a deeper depth so the lip notches 126*p* will extend deeper into the hole notch 126*h*, therefore eliminating any vertical and horizontal movement within the hole notch 126*h*. All the holes 36 can have hole notches 126*h* to eliminate vertical movement at the holes 36 or may be installed at the hole side edges 36*se* without the hole notch 126*h*. At the right no hole notches 126*h* are shown as the hole notches 126*h* can be a double lip notch 126*dp* or a double hole notch 126*dh*. If the hole notch 126*h* is wide enough for only one lip notch 126*p* the lower reverse lip spacer braces 301 would have its lip notch 126*p* not fit into the hole notch 126*h* and only the upper reverse lip spacer brace at the lip notch 126*p* would only engage the hole notch 126*h* keeping the lower spacer brace 301 tight against the hole bottom edge 36*be*. The width of upper oriented spacer brace has a narrower width web 301 with longer flanges 301*b* and longer lips to fit into the lower reverse lip spacer brace 301.

Figure 23:
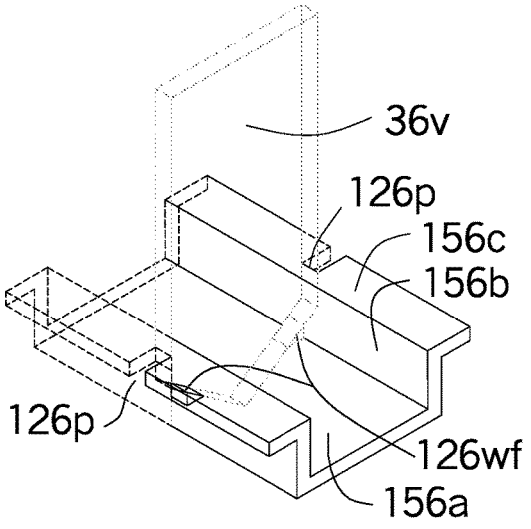
FIGS. 23 & FIG. 24 shows copies to 2 drawings shown in U.S. 62/175,191 filed Jun. 15, 2015 that represent some of the later FIGS. shown in this application.
Figure 24:
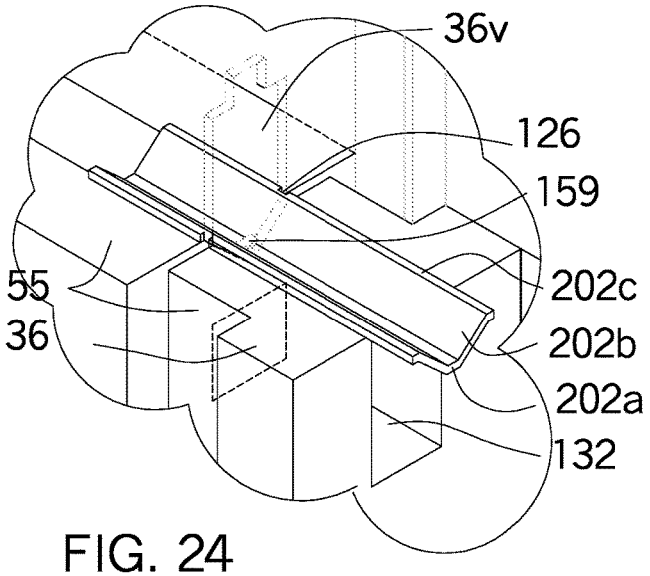

FIGS. 23 & FIG. 24 shows copies to 2 drawings shown in U.S. 62/175,191 filed Jun. 15, 2015 that represent some of the later FIGS. shown in this application. FIG. 23 shows the support member having a downward pointed V shaped hole 36*v* with angular side bottom edges at the web 42*a* of the C shaped channel 42 shown as the support member. A bracing member shown as a reverse lip channel 156 passes through the V shaped hole having flange-web notches 126*wf* indented into the web 156*a* and flanges 156*b* along with lips 156*c* extending outwardly with lip notches 126*p* at its outer edges engaging the side edges of the V shaped hole 36*v*. Another method to secure a bracing member to a hole in the support member is shown where the bottom side 156*d* and the two parallel sides 156*b* have notches 126 that are continuous to each other so the diagonal side edges of the downward pointing V shaped hole 36*v* engages the notches 126 at its bottom side 156*d* and the flanges 156*b* of the bracing member. The flanges should be angled as a gap is required in be installed between the hole side edges 36*se*.

FIG. 23 shows a bracing member shown as a modified V channel 202 passing through a V shaped hole 36*v* with a blunt end 159 at the vertex at the web 42*a* of the support member. The modified V channel 202 has a bottom side 202*a*, two angular sides 202*b* with lips 202*c* where the bottom side 202*a* and the two angular sides 202*b* have notches 126 for the blunt end 159 to fit into. The modified V channel 202 also uses notches 126 at the lips 202*c* to secure the modified V channel 202 to the V shaped hole 36*v*.

Figures 25, 26:
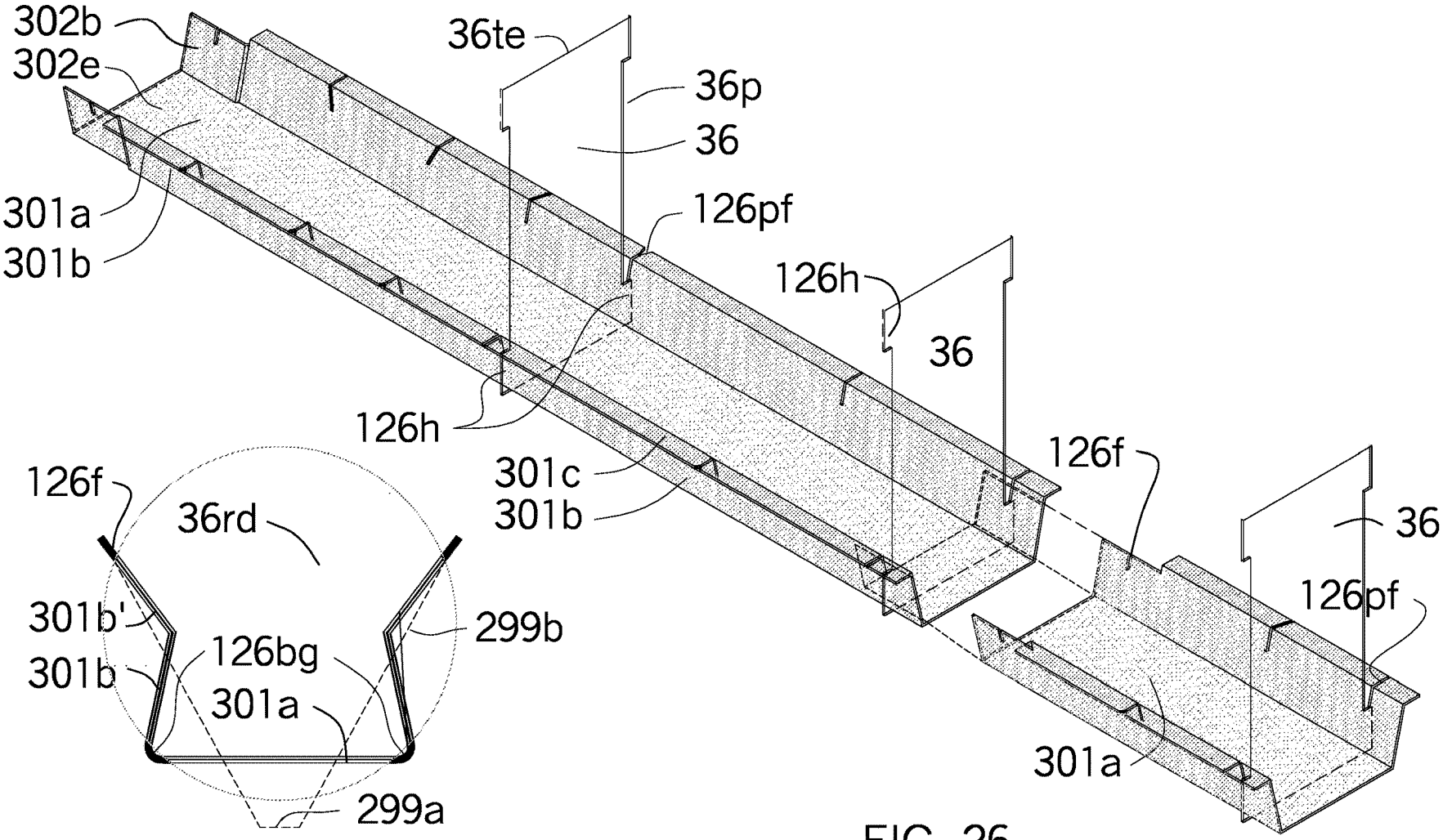
FIG. 25 shows a reconfiguration of FIG. 26 but shown extending through a round hole in a support member rather than the hole configurations in FIGS. 1-22.
FIG. 26 shows the spacer brace in FIGS. 1-22 shaded and further described.
Figure 31:
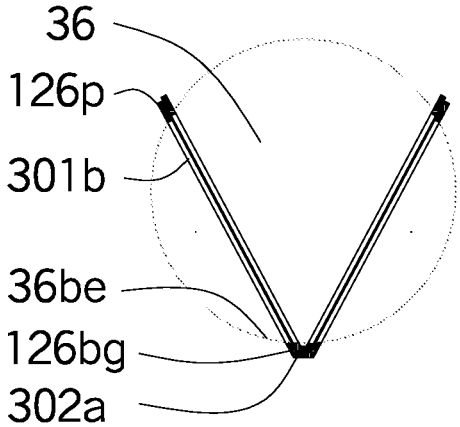
FIGS. 31 & 32 shows a V shaped spacer brace installed in a round hole with the legs extending upward and downward toward the bottom edge of the hole.

FIG. 25 shows a reconfiguration of FIG. 31 but shown extending through a round hole in a support member rather than the hole configurations in FIGS. 1-22. FIG. 25 shows a reverse lip spacer brace 301 having a web 301*a* with bent flanges 301*b* & 301*b*' passing through a round hole 36 having bulge notch 126*bg* indented into the web 301*a* and into the adjacent flange 301*b* and also having flange notches 126*f* indented into the distal end of the connecting flange 301*b*'. The 301*b* connecting to the web 301*a* is shown having an acute angle to the web 301*a* and many later FIGS. showing obtuse angles to the web 301*a*. Also show is V shape spacer brace that is described in FIGS. 36-49 where the web 301*a* is narrow and the flanges 301*b* have an obtuse angle, but seem to converge to a point or vertex, but really is converging to the web 301*a*.

Figure 30:
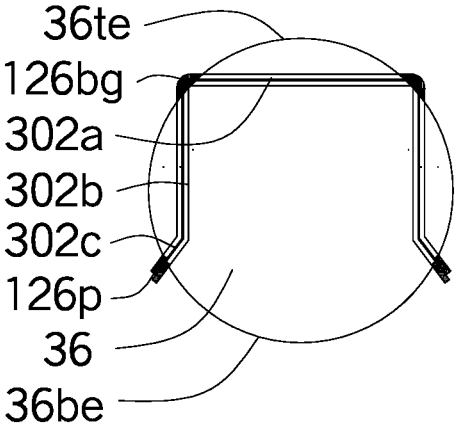

FIG. 26 shows the same spacer braces as shown in FIGS. 1-22, however the FIG. 26 is shaded to help distinguish the various planes used to form the reverse lip spacer brace 301 also shown in FIGS. 3, 4 and FIGS. 18-20. FIG. 26 show two spacer braces have a small end and a large end about to be connected through the holes 36 of the support members 42 with the reverse lip spacer brace 301 having flanges 301*b* extending horizontally with flange lip notches 126*pf* indented into the lips 301*c* and flanges 301*b*. The support members have holes 36 in the web 42*a* with large hole notches 126*h* indented into the hole side edge 36*se* leaving projection arms (hole top edges 36*te*) engaging the lip-flange notches 126*pf* from moving vertically and horizontally. An identical second spacer brace has the smaller end inserted into the larger reverse lip spacer brace 301 having a smaller U shape to fit snuggly into the first end with flange notches 126*fg* that also fit under the ledge protrusion or projection arm (hole top edges 36*te*) at the holes 36 in the support member 42. A round hole 36*r* in FIG. 30 uses a different configuration with bulge notches 126*bg* at the corners.

Figure 28:
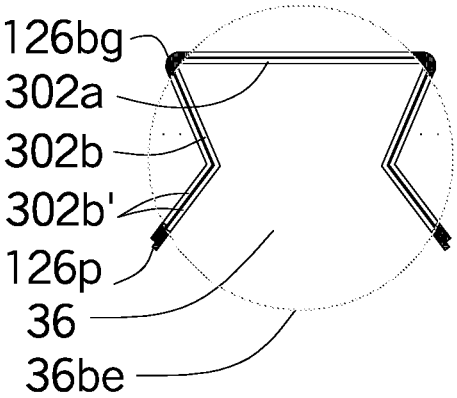
Figure 29:
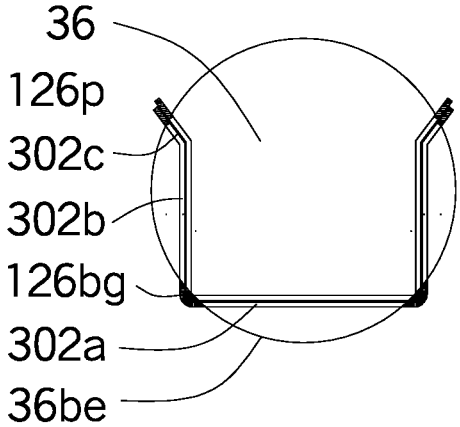
Figure 32:
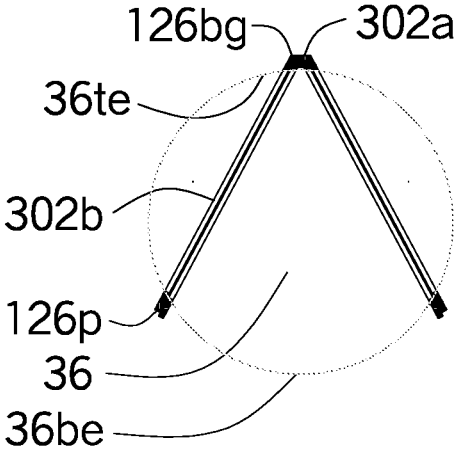

FIGS. 27-30 shows the U shaped spacer brace 302 having bent flanges 302*b* & 302*b*' and installed with the flanges extending upward or downward within the round hole 36*r*. FIGS. 31 & 32 show a V shaped spacer brace installed in a round hole with the legs extending upward and downward toward the bottom edge of the hole. FIGS. 27 & 28 show the same U shaped spacer brace 302 however FIG. 28 shows the U shaped spacer brace 302 inverted. Both FIGS. could be a reverse lip spacer brace 301 if the flange 302*b*' is referred to as a lip 302*c* because the lip is an extension of the flange 302*b*. The flange 302*b* without any longitudinal bend would be considered a U shaped spacer brace 302, however when a longitudinal bend is added the flange 302*b*' is then considered to be referred to as a lip and therefore the flange 302*b*' can also be referred to as a lip 301*c* of a reverse lip spacer brace 301 as shown in FIG. 25. The connection shown as a bulge notch 126*bg* occurs at the web 302*a* and the flange 302*b* with the bulge notch 126*bg* extending into both components. The flange 302*b* is shown as an acute angle to the web with the flange 302*b*' shown as an obtuse angle to flange 302*b* leaving the distal edge of flange 302*b*' having a flange notch 126*fg* or also referred to as a lip notch 126*p* should the space brace be referred to as a reverse lip spacer brace 301. The U shape space brace 302 is installed into a round hole 36*r* where the bulge notches 126*bg* at both sides engages two side edges of the hole 36, the hole 36*r* can be any congruent shape where two bulge notches 126*fg* can engage. When installing within the hole 36, the flanges 302*b*' are pressured inward allowing the flanges 302*b*' to flex inward allowing the lips notches 126*p* to also engage the hole side edges 36*se*. The figure shows a second U shaped spacer brace 302 inserted into the U shape configuration where the inserted U shaped spacer brace 302 is slightly smaller having a narrower width web 302*a*. When inserting the second U shape spacer brace 302 the flanges 302*b* & 302*b*' will both will want to bend move vertically like FIGS. 29 & 30. On the other hand, the smaller the width of the web 301*a* or 302*a* the more likely the configuration might be considered a V shape spacer brace 299 as shown in FIGS. 31 & 32.

Figure 33:
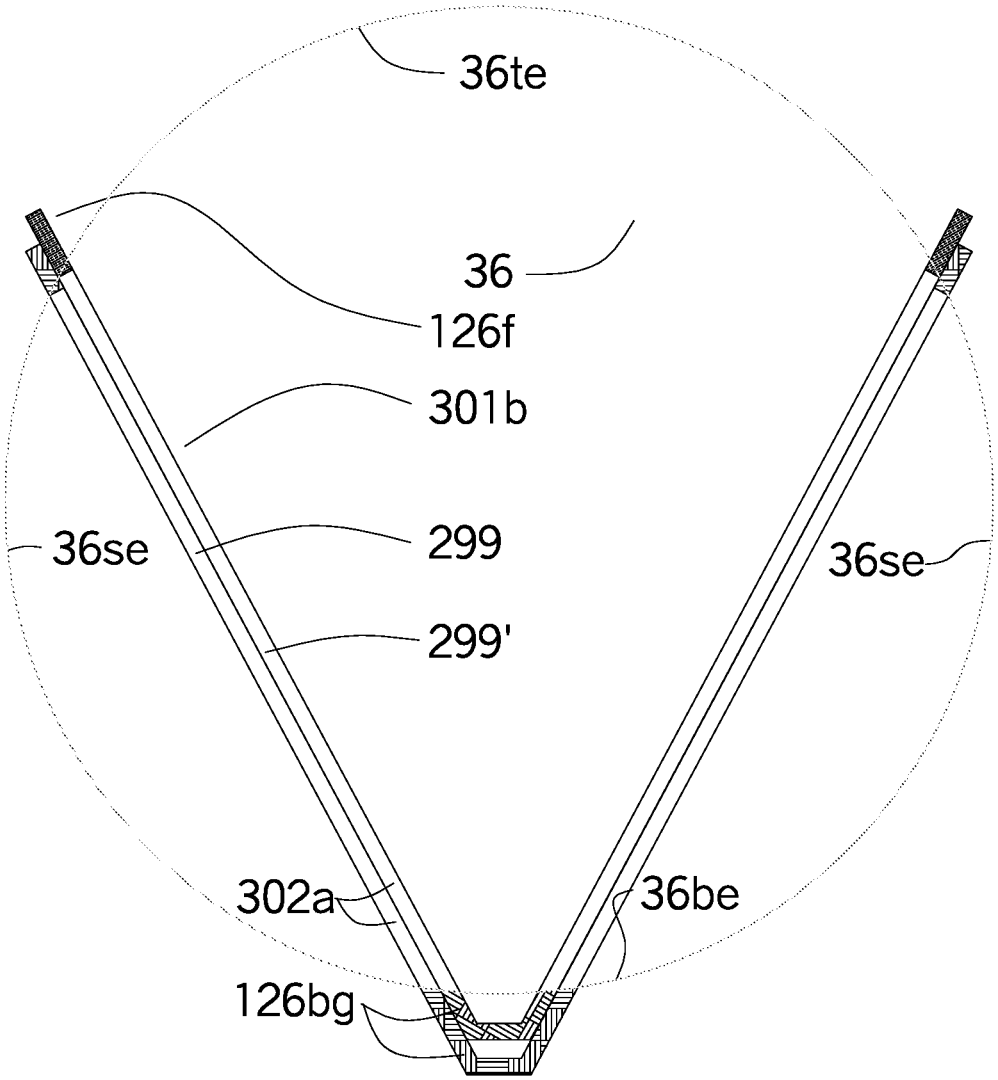
FIGS. 33 & 34 shows two V shaped spacer braces overlapping each other where FIG. 33 the V shaped spacer braces are the same size and FIG. 34 shows the V shaped spacer braces having a gap between the vertexes.
Figure 34:
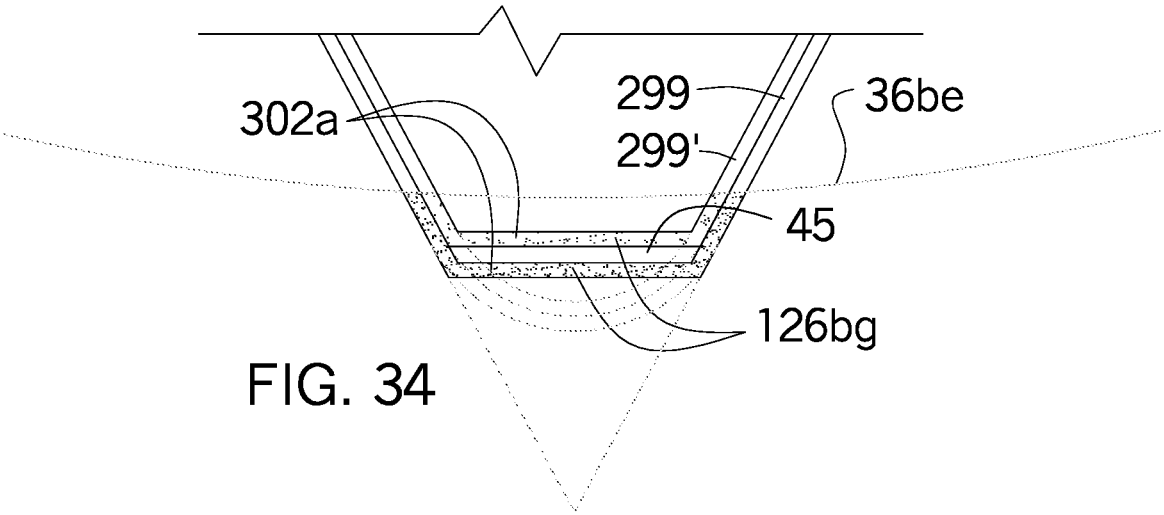
Figure 35:
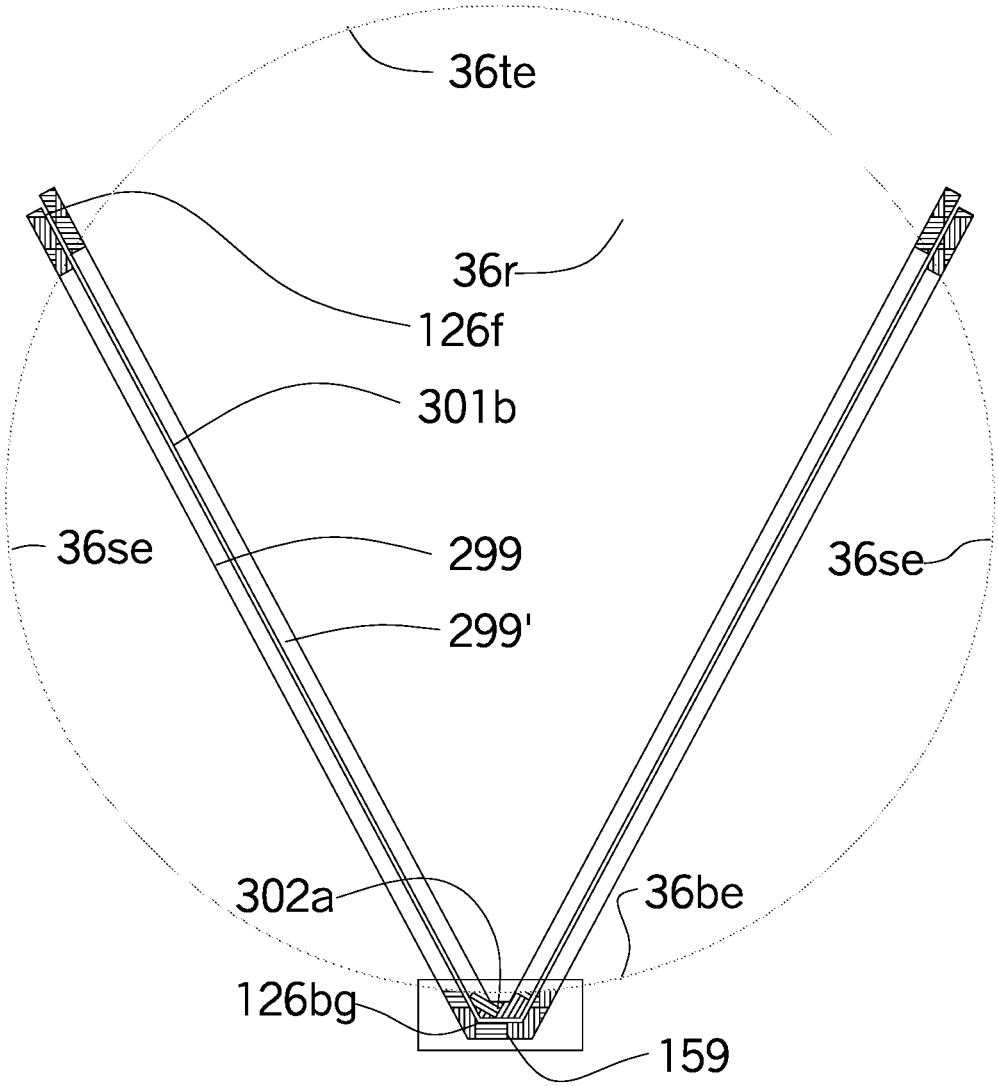
FIGS. 35 & 36 are similar to FIGS. 33 & 34 except here a narrower width V shaped spacer brace fits into a larger width V shaped spacer brace.
Figure 36:
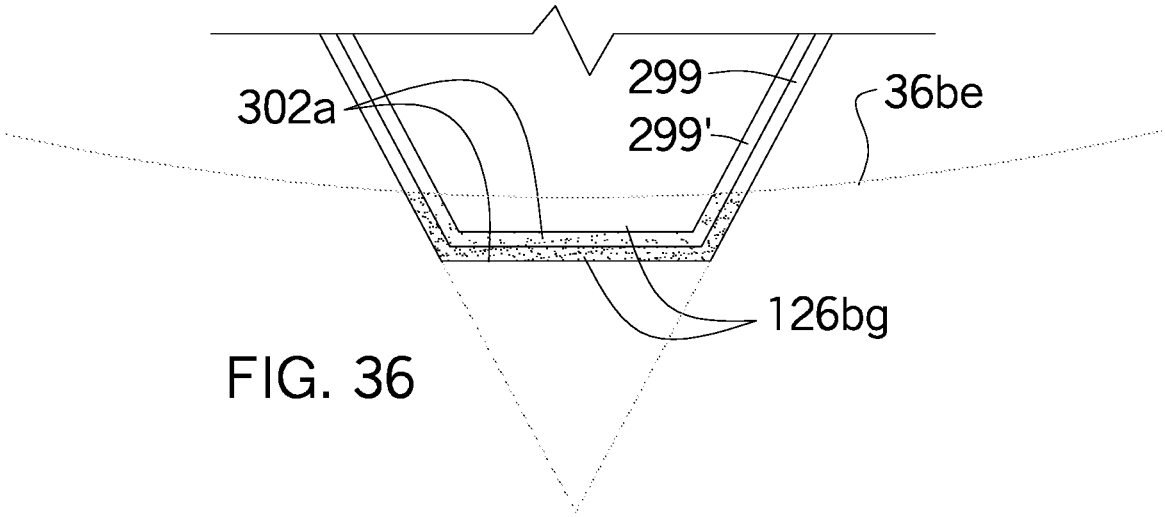
Figure 37:
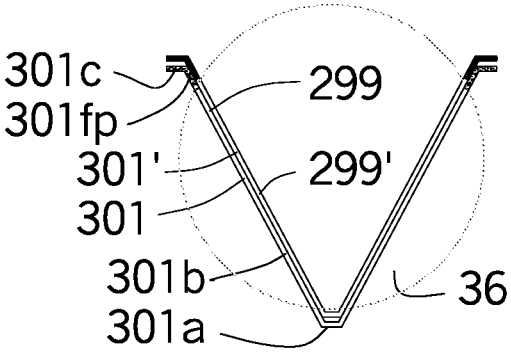
FIGS. 37-40 shows how the two reverse lip spacer brace being the same size fits into the round hole of the support member.

FIG. 33 shows two V shaped spacer braces 299 overlapping each other and where the V shaped spacer braces 299 are the same size leaving a gap 45 between the vertexes at shown in FIG. 34, but for explanation purposes the V shaped spacer brace 299' is shown as the inside V shaped spacer brace 299', but actually is installed overlapping the first V shaped spacer brace 299. FIGS. 35 & 36 are similar to FIGS. 33 & 34 except a narrower width V shaped spacer brace 299' fits into a larger width V shaped spacer brace 299. When this occurs, the larger width web 299*a* can be the dominant V shaped spacer brace 299 with the end portion (the area of the V shaped where the overlapping area occurs) can have a smaller or narrower web dimension similar to the web 299' as shown in FIG. 34. The overlapping occurs when the V shaped spacer braces 299 & 299' intersection and the bulge notches 126*bg* and the lip notches 126*p* have the respective notch openings engage the side edges of the hole 36. The V shaped spacer braces 299 & 299' can be installed as a domino type installation where the end configuration are both the same size leaving the gap 45 between the webs. Another variation is the end configuration has different width webs 299*a* and 299*a*' forming a tighter snuggle type connection creating more friction. Another alternative is installing the V shaped spacer braces in different holes 36 of the support member 42 creating a checker board pattern for installation rather than the continuous overlapping configuration as shown in FIGS. 1-4, 18-21, 43-44 and FIG. 51.

Figure 39:
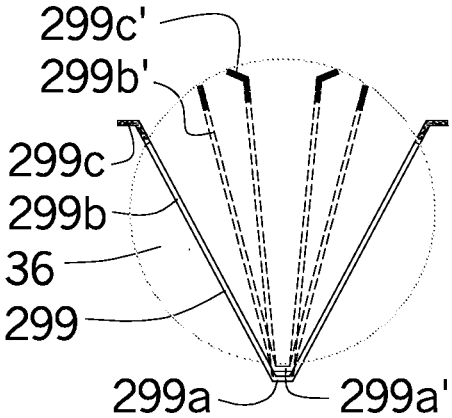
Figure 40:
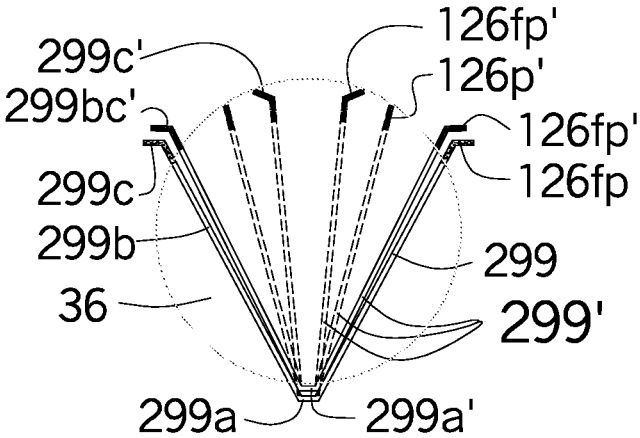
Figure 41:
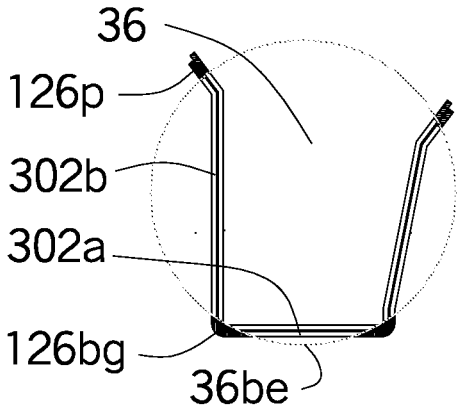
FIGS. 41 & 42 shows two different shaped U shaped spacer braces 302 having different length flanges 302*b*.
Figure 42:
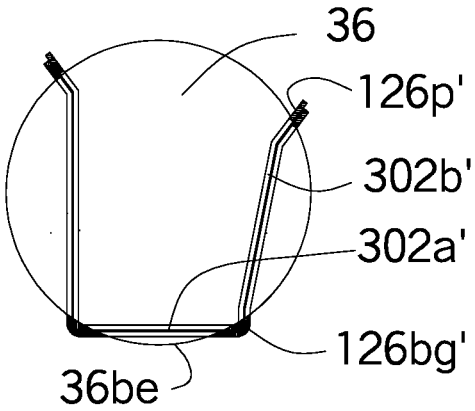

FIGS. 37-40 shows how the two reverse lip spacer brace 301, however the web 301*a* has a narrow configuration and the distal edges of the flanges 299*b* & 299*b*' are shown as having lips 301*c* with lip notches 126*p* being the same size fits into the round hole 36*r* of the support member 42. FIG. 38 shows the first reverse lip spacer brace 301 or the V shaped spacer brace 299. having the bulge notch 126*bg* at the web 301*a* and diagonal flanges 301*b* with flange notches at the distal edges of the flange 301*b*. The flanges are bent at the end extending away from the web and are referred to as lips 301*c*. When the reverse lip space brace 301 is being installed into the round hole 36*r* the flanges 301*b* are compressed together, with the flanges bending at the intersection of the web 301*a* and the flanges 301*b*. FIGS. 39 & 40 show a second overlapping V shape spacer brace 299 installed slightly higher from the vertex with a gap 45 between the vertex of the first and second V shaped lip spacer brace 299'. The lip 299*c* of the second V shaped spacer brace fits higher against the sloped flanges 299*b*, therefore making it more difficult to be inserted into the hole. The vertex has to have a deeper bulge notch 126*bg* to allow the lip 299*c* to extend through the hole 36 easier or the lip 299*c* could be eliminated thereby having a longer flange notch 126*fg* with FIG. 40 showing both reverse lip spacer braces overlapping with their notches connecting to the hole side edges 36*se* of the perimeter. FIGS. 41 & 42 shows two different shaped U shaped spacer braces 302 having different length flanges 302*b* or another shape not yet conceived.

Figure 43:
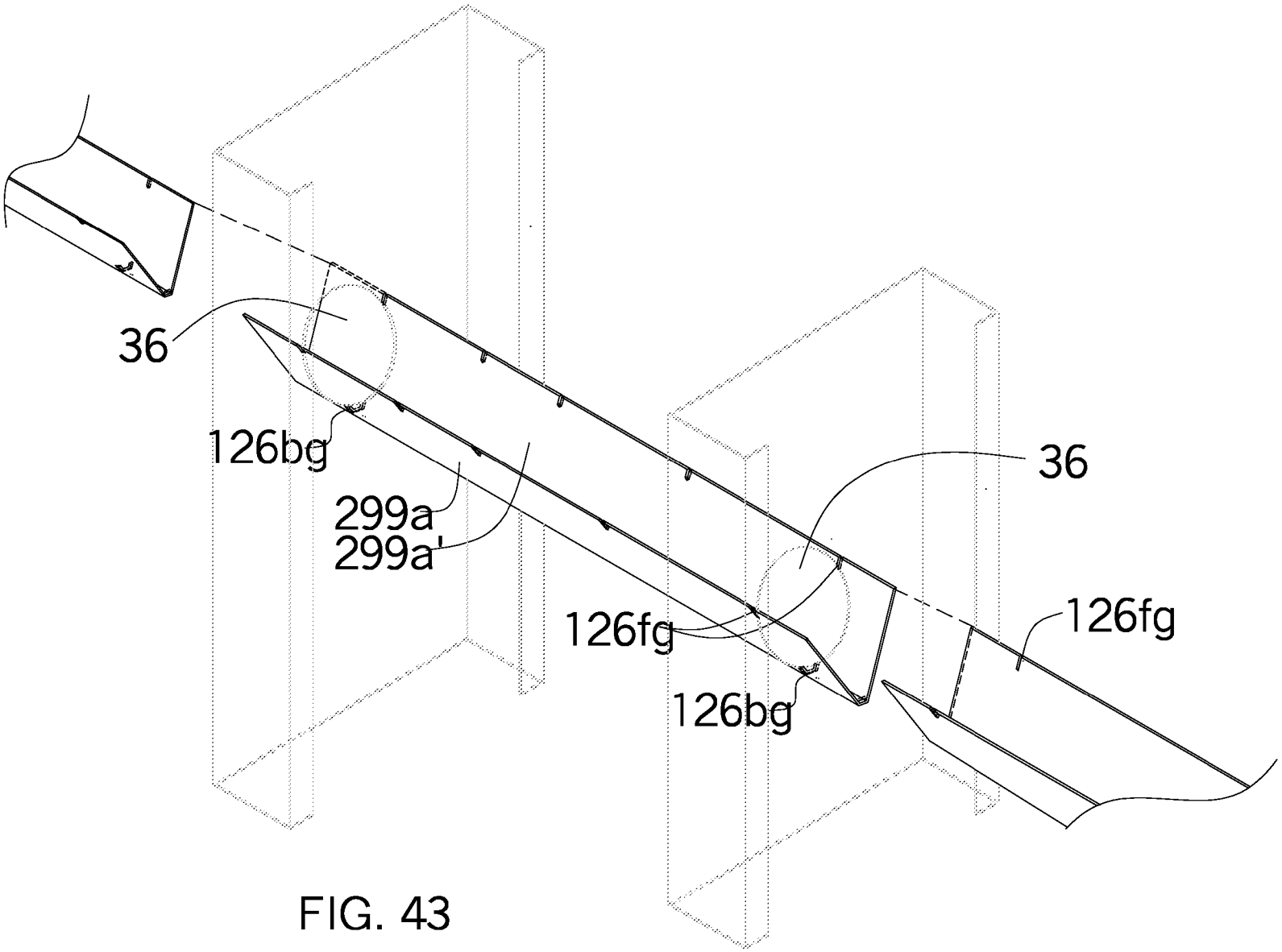
FIGS. 43 & 44 shows the U shaped spacer brace 302 having a web 302*a* and two flanges 302*b* with the flanges shown at an angle.
Figure 44:
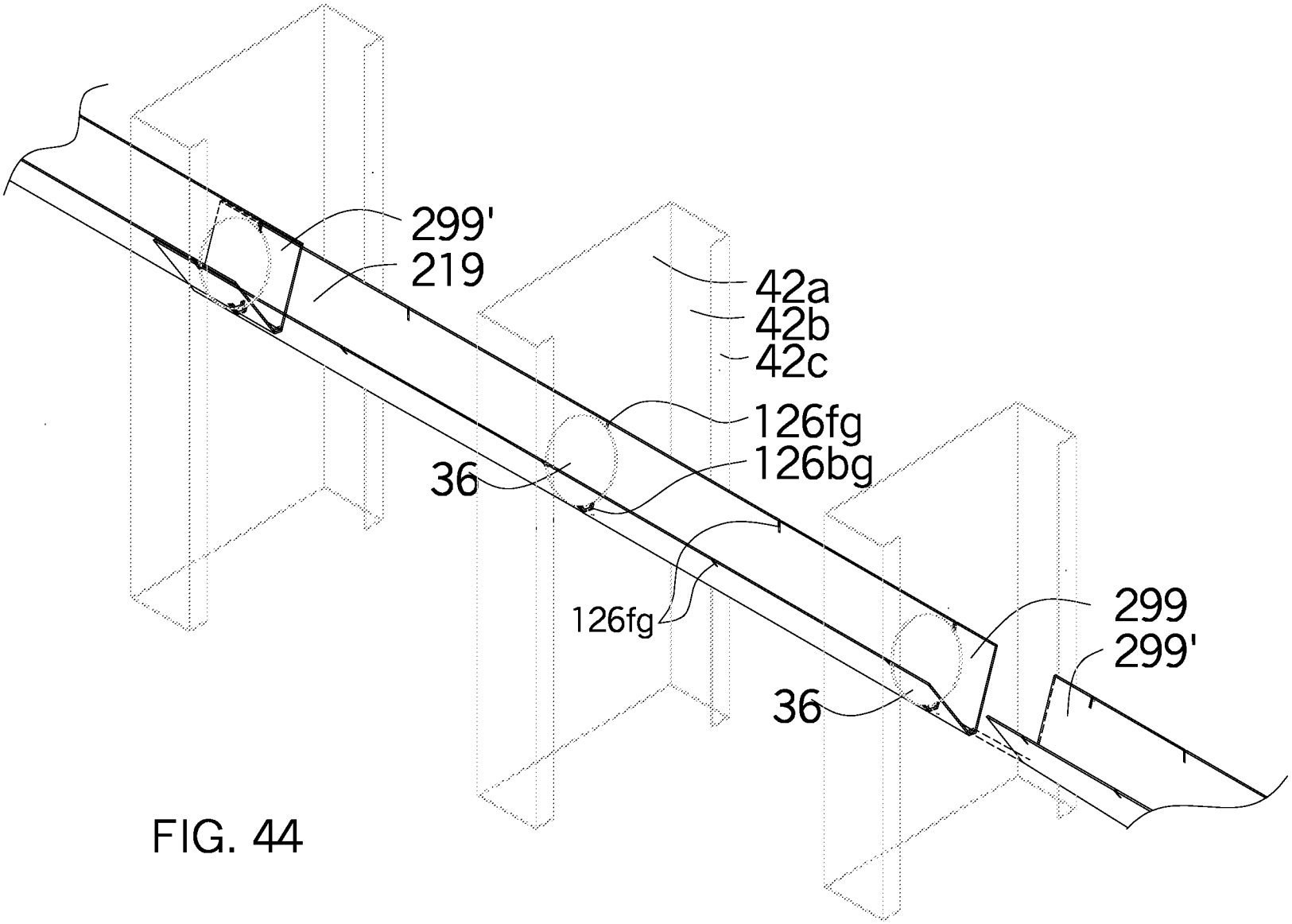

FIGS. 43 & 44 shows the U shaped spacer brace 302 having a web 302*a* and two flanges 302*b* with the flanges shown at an angle. A V angled channel has previously been shown as 199. FIG. 42 is an enlargement of the V shaped spacer brace 199 connecting several support members 42 together. FIG. 43 shows two same sized V shaped spacer braces 299 & 299' being overlapped and fitting snuggly together.

Figure 45:
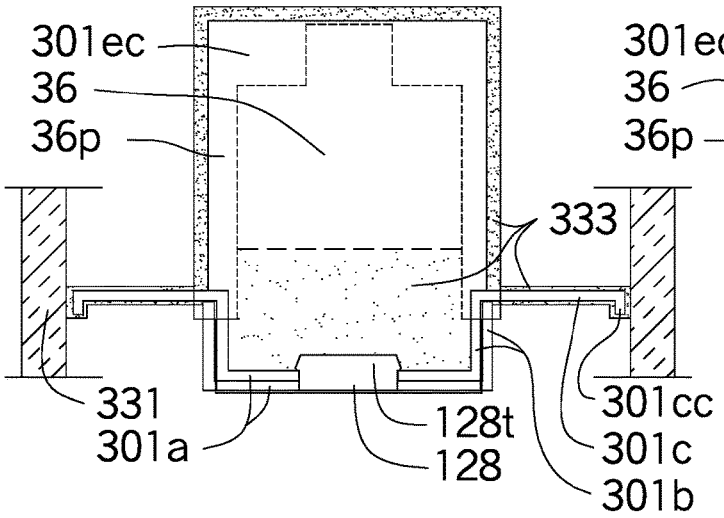
FIG. 45 shows a reverse lip spacer brace spanning between support members 42 with the lips 301*c* an additional lip 302*cc* extends parallel to the flanges 42*b* of the support member. Fire tape having an adhesive backing applied to the additional lip 301*cc* and around the edges of the hole 36 of the support members.
Figure 46:
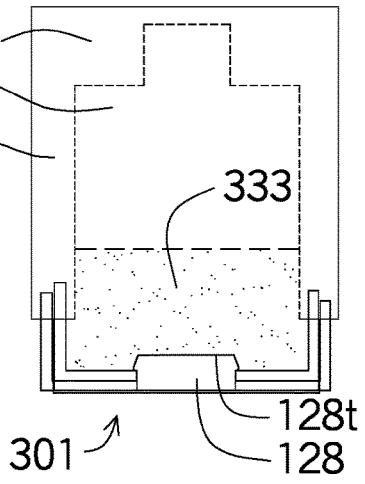
FIG. 46 shows an extension that protrudes through the hole allowing an adjacent reverse lip spacer brace 301 to rest upon and or a fire stop also having a fire tape applied to the support member.

FIG. 45 shows a reverse lip spacer brace 301 having a web 301*a*, a flange 301*b* extending upward from the web 301*a* and lips 301*c* extending from the distal edge of the flanges 301*b*. The reverse lip spacer brace spans between support members 42 with the lips 301*c* extending to the outside edge of the flanges 42*b* of the support member 42 and where an additional lip 302*cc* extends parallel to the flanges 42*b* of the support member. Other figures shows the additional lip abut the web 42*a* of the support member or overlap the flange 42*b* where the reverse lip spacer brace is used as fire blocking within and between support members 42. What is shown here is fire tape having an adhesive backing applied to the additional lip 301*cc* and around the edges of the hole 36 of the support members. FIG. 46 shows an extension that protrudes through the hole allowing an adjacent reverse lip spacer brace 301 to rest upon and or a fire stop also having a fire tape applied to the support member.

Figure 47:
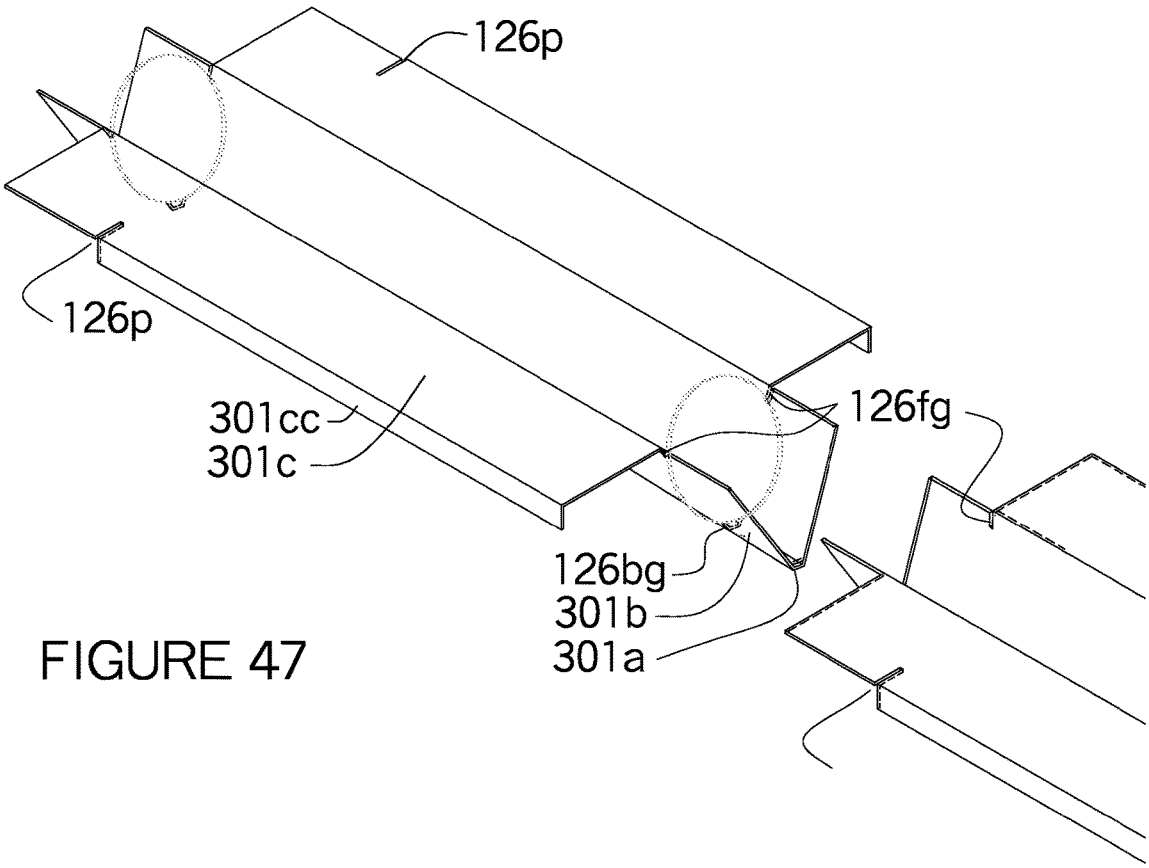
FIG. 47-50 shows the reverse lip spacer brace spanning between two support members with the V shaped ends overlapping at the hole and the lips extending to the support members with a lip extension extending over the support members.
Figure 48:
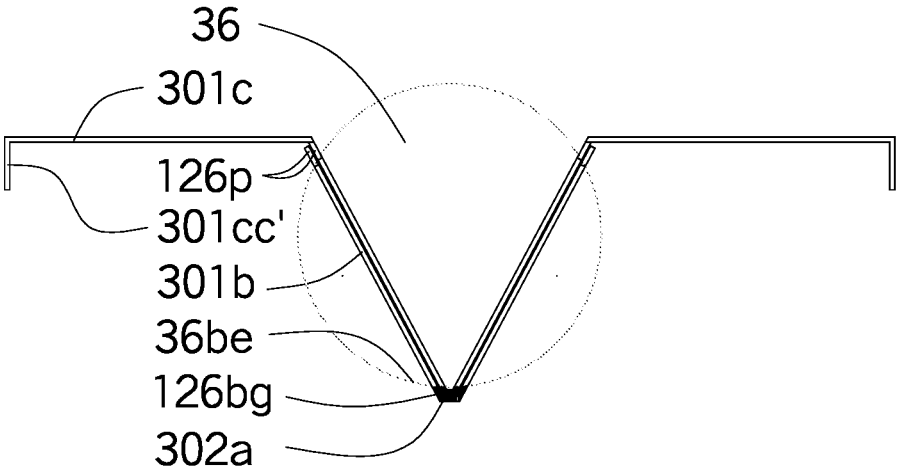
Figure 49:
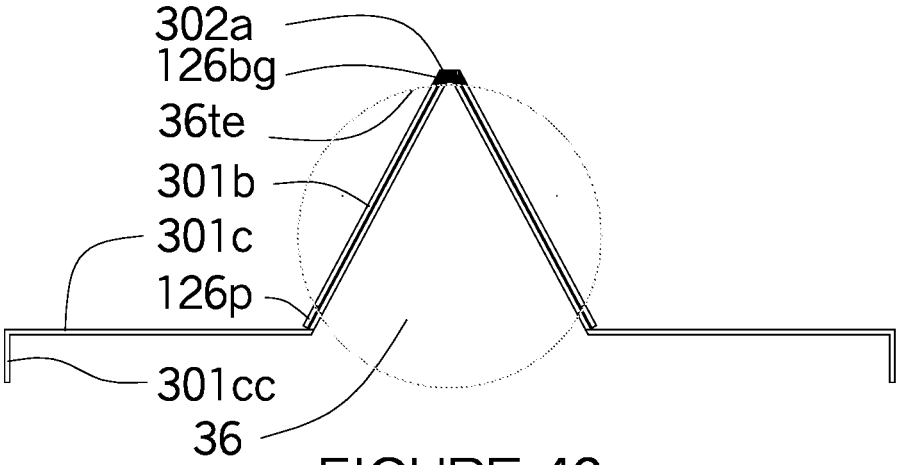
Figure 50:
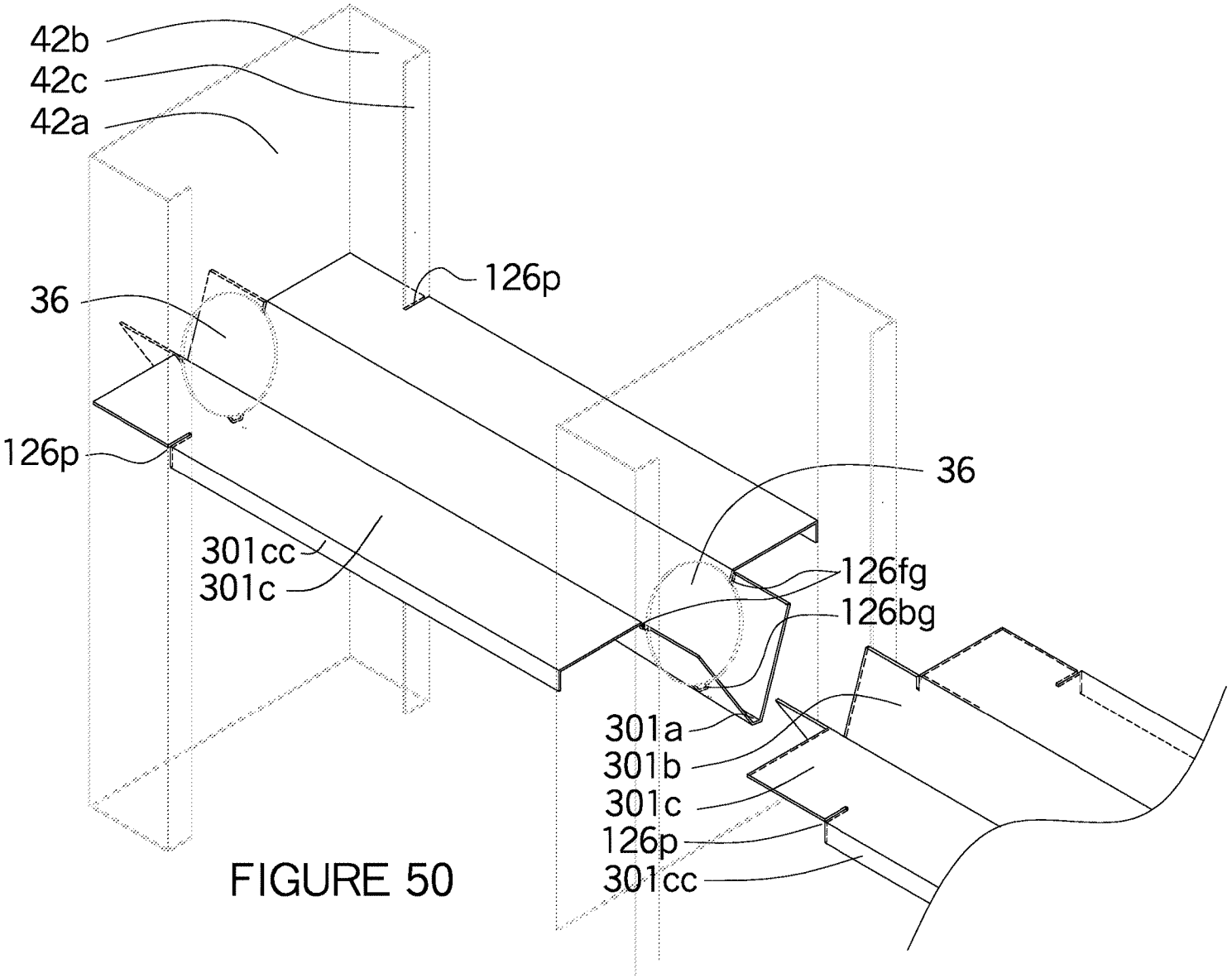

FIG. 47 is an isometric drawing of a reverse lip spacer brace 301 having a similar shape as FIG. 45 that is having the additional lip 301*cc* extending from the lip 301*c* and also similar to FIG. 25 where the angled flanges 301*b* are attached to the lips 301*c*. When the reverse lip spacer brace 301 has the lips 301*c* extending the full width of the web 42*a* of the support member 42, the reverse lip spacer brace 301 spans between adjacent support members 42 with only the angled flanges 301*b* and 301*b*' extend through the hole of the support member 42. It functions the same as the V shaped spacer brace 299 having notches at the ends of the legs and at the vertex. FIGS. 48 & 49 show a section through the V shaped spacer brace 299 with FIG. 48 having the vertex connecting the hole bottom edge and FIG. 49 with the vertex connecting the hole top edge. When the V shape has the open separated flanges 301*b* it is easier to install a second reverse lip shaped spacer brace 302' into the open flanges 302*b* as shown in FIGS. 37-40, on the other hand when the vertex is connected at or near the hole top edge it is next to impossible to make that connection. FIG. 50 is similar to FIG. 47 except the support members 42 are shown between the reverse lip spacer brace 301. The lip notches 126*p* are indented into the double lip 301*cc* and into the lip 301*c* for the lip 42*c* at the support member 42 can engage into the lip notch 126*p*.

Figure 51:
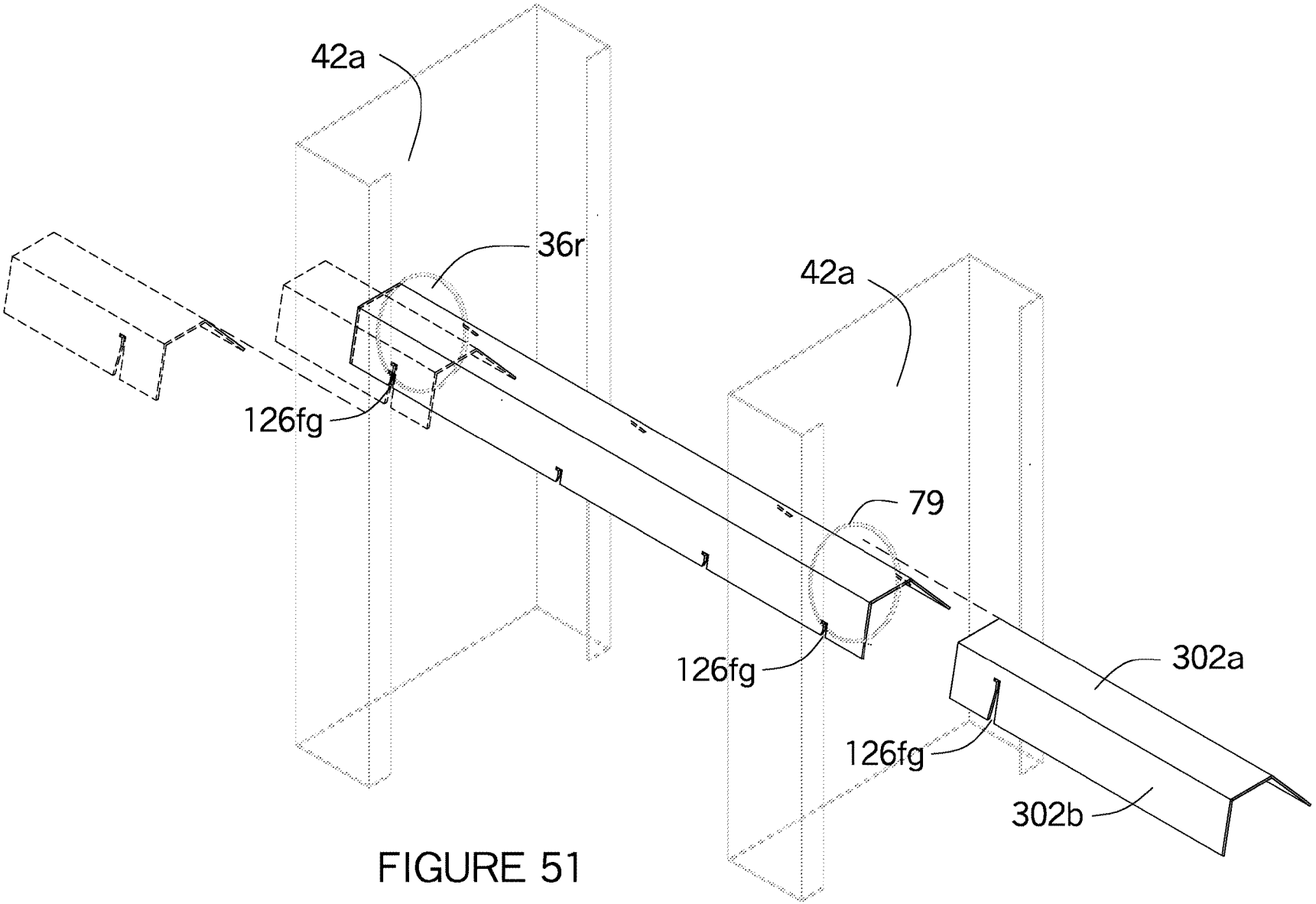
FIG. 51 shows an isometric drawing of a U shaped spacer brace 302 with the U facing downward having a web 302*a* with angled flanges 302*b* extending from the web 302*a*.

FIG. 51 shows an isometric drawing of a U shaped spacer brace 302 with the U facing downward having a web 302*a* with angled flanges 302*b* extending from the web 302*a*. The web 302*a* is narrower than the web 302*a* in FIG. 47, and wider than the web 302*a* in FIG. 50 approximately oriented in the middle of the round hole 36*r*. The flanges 302*b* have L shaped notches 126*fg* indented from the distal edge of the flanges 302*b*. The hole 36 has a continuous ledge 79 extending from hole perimeter that engages into the L-shaped notches 126*fg*. The U shaped spacer brace 302 is shown overlapping an adjacent U shaped spacer brace 302 with the L-shaped notches 126*fg* set back from the ends in order to have the L shaped notches 126*fg* be aligned, angled or offset to the L shaped notches 126*fg* at the opposing angled flange 302*b*. The U shaped space brace 302 has shorter flanges 302*b* and a wider width web 302*a* than the reverse lip spacer brace in FIG. 49; however lips 301*c* and double lips 301*cc* could extend from the flanges to form a similar configuration as shown in FIG. 49.

It is understood that the invention is not to be limited to the exact details of operation or structures shown and describing in the specification and drawings, since obvious modifications and equivalents will be readily apparent to those skilled in the art. The flexibility of the described invention is very versatile and can be used in many different types of building applications.

Glossary Terms

36 hole or aperture; 36*se*—hole side edge, 36*be*—hole bottom edge, 36*te*—hole top edge, 36*p*—hole protrusion, 36*pn*—protrusion nodule, 36*fs*—flange slot hole, 36*v*—V shape hole, 36*r*—round hole
42 support member, 42*a*—web, 42*b*—flange, 42*c*—lip
45 gap, 45*h*—hole gap
79 ledge
129 receiver, 129*sh*—receiver slot hole
156 reverse lip channel, 156*a*—web, 156*b*—flange
202 V channel, 202*a*—web, 202*b*—flange, 202*c*—lip
299 V shaped spacer brace, 202*a*—web, 202*b*—flange, 202*c*—lip
301 reverse lip spacer brace, 301*a*—web, 302*b*—flange, 302*c*—lip, 301*e*—extension, 301*g*—bulge, 301*ce*—extended lip, 301*cc*—lip extension
302 U shaped spacer brace, 302*a*—web, 302*b*—flange, 302*c*—lip, 302*cc*—added lip, 302*g*—bulge

The invention claimed is:

1. A structural framing system comprising:

a first support member, a second support member, a first spacing member, and a second spacing member with a first end and a second end connected by connector elements:

said first support member and said second support member each having a web with a first flange connected to a first side edge of said web and a first lip extending from said first flange, and a second flange connected to a second side edge of said web with a second lip extending from said second flange, said web having a planar wall with a first planar side and a second planar side with an aperture having a round shape extending therethrough, the aperture having a continuous perimeter side edge therearound;

said first and said second spacing member having a U-shape configuration with a first end and a second end, having a longitudinal web with said longitudinal web a first side edge and a second side edge, said first side edge connected to a first side wall with a distal edge and said second side edge connected to a second side wall with a distal edge, said distal edge of said first and said second side walls each has a first connector element comprising as a first side wall notch cut into the distal edge of said first side wall and a second side wall notch cut into the distal edge of said second side wall, a second connector element having said longitudinal web with a width comprising a continuous corner notch cut into said longitudinal web and cut into said first and said second side wall forming said continuous corner notch, and a third connector element having said longitudinal web with a width comprising a first corner notch cut into said longitudinal web extending into said first side wall, a second corner notch cut into said longitudinal web extending into said second side wall;

said notches of each of the first connector elements and the third connectors elements each having openings and the notch openings are aligned and cut at a non-zero angle and offset with respect to the continuous edge of said aperture of said first support member and said second support member, said first and second spacing members, with said first side wall and said second side wall able to bend, along with said lips, with said connector elements of one of the spacing members configured to receive said connector elements of the other spacing members, said connectors elements of one of the spacing members is configured to be received by said connector elements of the other said spacing members, said connector elements are spaced from said first end and said second end of the first and second spacing members and configured to be pressed fit into and pressed against said continuous edge of said aperture of said first support member and said aperture of said second support member.

2. The structural framing system according to claim 1, wherein said first side wall and said second side wall at said first and second spacing members have angular side walls with multiple planes with said longitudinal web and said first and said second side walls having multiple connector elements.

3. The structural framing system according to claim 1, wherein a gap occurs between said longitudinal web of said second spacing member and said first spacing member when a width of the longitudinal web of the first spacing member is the same as a width of the longitudinal web of the second spacing member and when the spacing members overlap each other, said first and said second walls extend from the longitudinal web and are angled such that the distance between the distal edges of said first and said second side walls is greater than the width of the longitudinal web of the first and second spacing members.

4. The structural framing system according to claim 2, wherein said first spacing member and said second spacing member oriented with said U shape turned downward or upward, said first end of said first spacing member overlaps said second end of the opposing second spacing member, said U-shape configuration has said first and said second side wall with sloping side walls with said side wall notches, said web of said first spacing member overlaps said web of said second spacing member, said first end and said second end of said second spacing members overlap at said apertures with said first, second or third connector elements engaging said apertures at a first perimeter side edge and a second perimeter edge along said continuous perimeter side edge of said apertures, said connector elements being aligned, angled or offset to said opposing side wall connector elements to create friction.

5. The structural framing system according to claim 4, wherein said web of said first spacing member is wider than the web of the second spacing member, first and said second side walls extending downward at a slight angle forming a continuous U-shape configuration for said second spacing member to overlap said first spacing member by stacking the first or second end of said larger width web of over the smaller width web said connector elements aligned with engage said perimeter side edges of said apertures.

6. The structural framing system according to claim 4 wherein said first spacing member with the larger width configured to engage said aperture of said first support member and engage said second end of said aperture at said second support member, said second spacing member with said smaller width web overlaps said second end of said first spacing member having a smaller width web to overlap said second end of said first support member, said smaller width web overlapping into said larger width web having said U shape spaces facing upward and in reverse with said first and said second bracing member are facing downward with said larger web fitting over said smaller web.

7. The structural framing system according to claim 2 wherein said web attached to said first side wall and said web attached to said second side wall, said first and said second side wall has a third side wall attached to said first side wall forming a first lip and a fourth side wall attached to said second side wall forming a second lip with indentations cut into said first and said second lip forming a first lip notch and a second lip notch, said first and said second lip notch able to engage the perimeter side edge of said aperture at said first support member, said first lip and said second lip has a third lip notch and a fourth lip notch at said second end setback from the first end and the second end to engage said continuous edge of said aperture at said first and said second support member, said notches setback from said first end and said second end.

8. The structural framing system according to claim 7 wherein said first spacing member at said first end has said web, said first side wall with said first side wall notch and said second side wall with said second side wall notch to engage the aperture at said perimeter side edge of said first support member, said first side wall has said first lip extending to abut said first flange of said first support member and said second side wall with said second lip extending to abut said second flange of said first support member, said first lip has a first lip notch and said second lip has a second lip notch said first and said second lip to engage said first and said second lips of said first support member, said first and said second lip further extend forming a third lip and a fourth lip, said third and said fourth lip bent to align or extend over said first and said second flange of said first and said second support member, said first and said second lip abuts said web of said second support member, said first and said second side wall extend through said aperture, engage said aperture with a third notch and a fourth notch cut into said first and said side wall of said aperture.

9. The structural framing system according to claim 8 wherein said third lip notch engages the first flange of said support member and said fourth lip notch engages the second flange of said support member with said first lip and said second lip further extending past said first flange and said second flange of said support member and bent flush with said first and said second flange.

10. The structural framing system according to claim 7, wherein said first spacing member spans between said aperture at said first support member and said aperture at said second support member, with said web attached to said first side wall, said first side wall attached to said first lip having a distal edge attached to a first extended lip extending to said first flange of said support member, said web attached to said second side wall, said second side wall attached to said second lip having a distal edge attached to a second extended lip extending to said second flange of said support member, said first lip and said second lip have an indentation cut into said first and said second lip forming a first lip notch and a second lip notch to engage said perimeter side edges of said aperture in said first and said second support member, said first spacing member with said first lip has an extended and said second lip has said first and said second extended lip with a bent edge to overlap said first and second flanges of said support member.

11. The structural framing system according to claim 8 wherein said second end of said first spacing member overlaps said first end of said second spacing member from the opposing direction with said first end fitting under or over said first spacing member using said first, said second or said third connector element engaging said aperture of said second support member.

12. The structural framing system according to claim 7 wherein said second end of said first and said second spacing member has said first side wall with a first side wall extension forming a first lip and said second side wall has a second side wall extension to form a second lip, said first lip has a first lip extension and said second lip has a second lip extension, said first lip extension is bent toward said first lip forming an angle with a gap between said first lip and said first lip extension forming a first hemmed edge, said second lip extension is bent toward said second lip forming an acute angle with a gap between said second lip and said second lip extension forming a second hemmed edge, said first and said second hemmed edge has a lip-hemmed notch cut into the bend at said gap forming a first lip-hemmed notch and a second lip-hemmed notch.

13. The structural framing system according to claim 10 wherein said first and said second spacing member has lip-hemmed edges with said lip-hemmed notches setback from said second end, with said first end having said first and said lip with said first lip notch and said second lip notch with no said lip extension, said first end of said first spacing member overlaps said second end of said second spacing member with said first and second lips of said first spacing member fitting into said gap at said first and said second lip-hemmed edges at said second spacing member using pressure to fit into said first and said second lip-hemmed notches to engage said first and said second perimeter side edges of said aperture.

14. The structural framing system according to claim 1 wherein said first spacing member and said second spacing member has said web with said first side wall with said first web-flange notch with said second side wall with said second web-flange notch each having a continuous indentation at said web forming a second connector element with a flange-web-flange notch at said first end and said second end able to engage said perimeter side edges of said round aperture or said irregular shape configuration at said first and second support members and able to overlap at said first end over said second spacing member with said web having a narrower, wide or the same width and said third components elements have angled or offset flange-web-flange notches.

15. The structural framing system according to claim 1 wherein said first spacing member has a wide width at said web able to form a corner by having said first side edge connect to said first side wall, said web with the wide width has said second side edge connecting to said second side wall forming a second corner, said first corner having an indentation cut into said first corner forming a first web-flange notch, said second corner having an indentation cut into said second corner forming a second web-flange notch, said first web-flange notch to engage said first perimeter side edge of said aperture and said second web-flange notch to engage said second perimeter side edge of said aperture at the first end of said first support member, with said first and said second web-flange notch engaging said first and said second perimeter side edge of said aperture at the second end of said second support member and each setback from said first end and said second end, said first and said second web-flange notch is the alternative third connector element used with a wide width said web.

16. The structural framing system according to claim 14 wherein said first spacing member has a wide width at said web forming two corner notches as said first web-flange notch and said second web-flange notch at said first end and said second end, a said second spacing member identical to said first spacing member has said first end overlap said second end of said first spacing member at said aperture of said second support member.

* * * * *